US009953590B2

(12) United States Patent
Ben-David et al.

(10) Patent No.: US 9,953,590 B2
(45) Date of Patent: Apr. 24, 2018

(54) COLOR DISPLAY DEVICES AND METHODS WITH ENHANCED ATTRIBUTES

(75) Inventors: Ilan Ben-David, Rosh Ha'nyin (IL); Shmuel Roth, Petach Tikva (IL); Moshe Ben-Chorin, Rehovot (IL); Dan Eliav, Zichron Yaakov (IL)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 3375 days.

(21) Appl. No.: 10/492,616

(22) PCT Filed: Apr. 13, 2003

(86) PCT No.: PCT/IL03/00307

§ 371 (c)(1),
(2), (4) Date: Feb. 2, 2005

(87) PCT Pub. No.: WO03/088203

PCT Pub. Date: Oct. 23, 2003

(65) Prior Publication Data

US 2005/0122294 A1 Jun. 9, 2005

Related U.S. Application Data

(60) Provisional application No. 60/371,419, filed on Apr. 11, 2002.

(51) Int. Cl.
*G09G 3/36* (2006.01)
*G09G 5/02* (2006.01)
(Continued)

(52) U.S. Cl.
CPC ..... *G09G 3/3607* (2013.01); *G09G 3/2003* (2013.01); *G09G 5/02* (2013.01);
(Continued)

(58) Field of Classification Search
CPC .. G09G 3/36; G09G 3/30; G09G 5/00; G09G 5/02; G06F 3/038
(Continued)

(56) References Cited

U.S. PATENT DOCUMENTS 3,699,244 A 10/1972 Cohen et al.
3,870,517 A * 3/1975 Ota et al. ..... 430/38
(Continued)

FOREIGN PATENT DOCUMENTS

EP 0367848 5/1990
EP 0367849 5/1990
(Continued)

OTHER PUBLICATIONS

U.S. Appl. No. 10/017,546, filed Dec. 18, 2001, Ben Chorin et al.
(Continued)

*Primary Examiner* — Pegeman Karimi
(74) *Attorney, Agent, or Firm* — Pearl Cohen Zedek Latzer Baratz LLP

(57) ABSTRACT

A color display device for displaying an n-primary color image, wherein n is greater than three, the device including an array of sub-pixel (801) configured to have at least one repeating unit having one sub-pixel representing each of the n primary colors, wherein repeating unit (906) is configured to optimize at least one attribute of the n-primary color image.

66 Claims, 23 Drawing Sheets

(51) Int. Cl.
*G09G 3/20* (2006.01)
*G09G 5/28* (2006.01)
*G09G 5/36* (2006.01)

(52) U.S. Cl.
CPC ..... *G09G 5/28* (2013.01); *G09G 5/363* (2013.01); *G09G 2300/0452* (2013.01); *G09G 2320/0666* (2013.01); *G09G 2340/0407* (2013.01); *G09G 2340/0457* (2013.01)

(58) Field of Classification Search
USPC ..... 345/3.3, 87–92, 690, 694–699; 349/144
See application file for complete search history.

(56) References Cited

U.S. PATENT DOCUMENTS 4,390,893 A 6/1983 Russell et al.
4,751,535 A 6/1988 Myers
4,800,375 A * 1/1989 Silverstein et al. ..... 345/694
4,843,381 A 6/1989 Baron
4,843,573 A 6/1989 Taylor et al.
4,892,391 A 1/1990 Stewart et al.
4,952,972 A 8/1990 Someya
4,953,953 A 9/1990 Fergason
4,985,853 A 1/1991 Taylor et al.
4,994,901 A 2/1991 Parulski et al.
5,042,921 A 8/1991 Sato et al.
5,087,610 A 2/1992 Hed
5,184,114 A 2/1993 Brown
5,191,450 A 3/1993 Yajima et al.
5,214,418 A 5/1993 Fukumura et al.
5,233,183 A 8/1993 Field
5,233,385 A 8/1993 Sampsell
5,243,414 A 9/1993 Dalrymple et al.
5,337,068 A 8/1994 Stewart et al.
5,345,322 A 9/1994 Fergason
5,375,002 A * 12/1994 Kim et al. ..... 358/521
5,416,890 A 5/1995 Beretta
5,447,811 A 9/1995 Buhr et al.
5,455,600 A 10/1995 Friedman et al.
5,563,621 A 10/1996 Silsby
5,565,742 A * 10/1996 Shichao ..... H01J 1/18 313/257
5,592,188 A 1/1997 Doherty et al.
5,614,925 A 3/1997 Braudaway et al.
5,631,734 A 5/1997 Stern et al.
5,642,176 A * 6/1997 Abukawa et al. ..... 349/106
5,650,942 A 7/1997 Granger
5,657,036 A 8/1997 Markandey et al.
5,724,062 A 3/1998 Hunter
5,736,754 A 4/1998 Shi et al.
5,740,334 A 4/1998 Lin et al.
5,751,385 A 5/1998 Heinze
5,784,038 A 7/1998 Irwin
5,821,913 A 10/1998 Mamiya
5,835,099 A 11/1998 Marimont
5,841,494 A 11/1998 Hall
5,844,540 A 12/1998 Terasaki
5,844,699 A 12/1998 Usami et al.
5,859,508 A * 1/1999 Ge ..... H01J 29/028 313/422
5,863,125 A 1/1999 Doany
5,870,530 A 2/1999 Balasubramanian
5,872,898 A 2/1999 Mahy
5,892,891 A 4/1999 Dalal et al.
5,909,227 A 6/1999 Silverbrook
5,936,617 A * 8/1999 Uchino et al. ..... 345/204
5,982,347 A 11/1999 Shigeta et al.
5,982,541 A 11/1999 Li et al.
5,999,153 A 12/1999 Lind et al.
6,018,237 A 1/2000 Havel
6,058,207 A 5/2000 Tuijn et al.
6,069,601 A 5/2000 Lind et al.
6,072,464 A 6/2000 Ozeki
6,097,367 A 8/2000 Kuriwaki et al.
6,100,861 A * 8/2000 Cohen et al. ..... 345/88
6,115,016 A 9/2000 Yoshihara et al.
6,144,420 A 11/2000 Jung
6,147,720 A 11/2000 Guerinot et al.
6,160,596 A 12/2000 Sylvester et al.
6,191,826 B1 2/2001 Murakami et al.
6,198,512 B1 3/2001 Harris
6,220,710 B1 4/2001 Raj et al.
6,224,216 B1 5/2001 Parker et al.
6,231,190 B1 5/2001 Dewald
6,236,390 B1 5/2001 Hitchcock
6,236,406 B1 5/2001 Li
6,239,783 B1 * 5/2001 Hill et al. ..... 345/694
6,243,070 B1 6/2001 Hill et al.
6,246,396 B1 6/2001 Gibson et al.
6,256,073 B1 7/2001 Pettitt
6,259,430 B1 7/2001 Riddle et al.
6,262,710 B1 7/2001 Smith
6,262,744 B1 7/2001 Carrein
6,280,034 B1 8/2001 Brennesholtz
6,304,237 B1 10/2001 Karakawa
6,324,006 B1 11/2001 Morgan
6,366,291 B1 4/2002 Taniguchi et al.
6,380,961 B1 4/2002 Van Der Loop et al.
6,384,839 B1 * 5/2002 Paul ..... 345/613
6,388,648 B1 5/2002 Clifton et al.
6,407,766 B1 6/2002 Ramanujan et al.
6,456,301 B1 9/2002 Huang
6,459,425 B1 10/2002 Holub et al.
6,467,910 B1 10/2002 Sato
6,498,592 B1 12/2002 Matthies
6,538,742 B1 3/2003 Ohsawa
6,570,584 B1 * 5/2003 Cok et al. ..... 345/690
6,577,291 B2 6/2003 Hill et al.
6,580,482 B1 6/2003 Hiji et al.
6,594,387 B1 7/2003 Pettitt et al.
6,595,648 B1 7/2003 Woodgate et al.
6,633,302 B1 10/2003 Ohsawa
6,687,414 B1 * 2/2004 Edgar ..... 382/275
6,707,516 B1 3/2004 Johnson et al.
6,750,992 B1 6/2004 Holub
6,833,888 B2 12/2004 Song et al.
6,870,523 B1 3/2005 Ben-David et al.
6,882,384 B1 4/2005 Sharp
6,897,876 B2 * 5/2005 Murdoch et al. ..... 345/589
6,952,194 B1 10/2005 Yanfazaki et al.
6,972,736 B1 12/2005 Wada et al.
7,129,955 B2 10/2006 Motomura
7,136,083 B2 11/2006 Tezuka et al.
7,206,005 B2 4/2007 Yamashita et al.
7,268,757 B2 9/2007 Ben-David et al.
7,492,379 B2 * 2/2009 Credelle et al. ..... 345/695
2001/0035922 A1 11/2001 Park et al.
2002/0005829 A1 1/2002 Ouchi
2002/0015046 A1 2/2002 Okada et al.
2002/0024618 A1 * 2/2002 Imai ..... 348/743
2002/0051111 A1 * 5/2002 Greene et al. ..... 349/149
2002/0054424 A1 * 5/2002 Miles ..... 359/291
2002/0060689 A1 5/2002 Iwata et al.
2002/0061369 A1 5/2002 Kunimatsu et al.
2002/0097365 A1 * 7/2002 Yang et al. ..... 349/141
2002/0122019 A1 9/2002 Baba et al.
2002/0149546 A1 10/2002 Ben-Chorin et al.
2002/0163526 A1 11/2002 Haseltine
2002/0167528 A1 11/2002 Edge
2002/0186229 A1 12/2002 Brown Elliott
2002/0191130 A1 * 12/2002 Liang et al. ..... 349/108
2003/0085906 A1 5/2003 Elliott et al.
2003/0146891 A1 8/2003 Poliakine
2004/0177323 A1 9/2004 Kaasila et al.
2007/0001994 A1 1/2007 Roth
2008/0024410 A1 1/2008 Ben-David et al.
2008/0030447 A1 2/2008 Ben-David et al.

FOREIGN PATENT DOCUMENTS

EP 0547603 6/1993
EP 0653879 5/1995
EP 1 087 341 3/2001

(56) References Cited

FOREIGN PATENT DOCUMENTS

| | | |
|---|---|---|
| GB | 2 139 393 | 11/1984 |
| JP | 59 159131 | 9/1984 |
| JP | 60 263122 | 12/1985 |
| JP | 62 222774 | 9/1987 |
| JP | 3092888 | 4/1991 |
| JP | 07043658 | 2/1995 |
| JP | 8-248410 | 9/1996 |
| JP | 09251160 | 9/1997 |
| JP | 10-307205 | 11/1998 |
| JP | 2000-171799 | 6/2000 |
| JP | 2000253263 | 9/2000 |
| JP | 2000321993 | 11/2000 |
| JP | 2000-34732 | 12/2000 |
| JP | 2000338950 | 12/2000 |
| JP | 2001209047 | 8/2001 |
| JP | 2001-306023 | 11/2001 |
| JP | 2000116789 | 11/2001 |
| JP | 2001105148 | 1/2002 |
| JP | 2002041022 | 2/2002 |
| JP | 2002-091369 | 3/2002 |
| JP | 2002173783 | 6/2002 |
| JP | 2001123661 | 10/2002 |
| JP | 2008280038 | 11/2008 |
| JP | 2009230301 | 10/2009 |
| JP | 1091083 | 11/2010 |
| JP | 11-052327 | 3/2011 |
| WO | WO 95/10160 | 4/1995 |
| WO | WO 97/35424 | 9/1997 |
| WO | WO 97/42770 | 11/1997 |
| WO | WO 00/45368 | 8/2000 |
| WO | WO 01/95544 | 12/2001 |
| WO | WO 02/11112 | 2/2002 |
| WO | WO 02/50763 | 6/2002 |
| WO | WO 02/091299 | 11/2002 |
| WO | WO 02/091348 | 11/2002 |
| WO | WO 02/091349 | 11/2002 |
| WO | WO 02/099557 | 12/2002 |
| WO | WO 02/101644 | 12/2002 |
| WO | WO 03/058587 | 7/2003 |

OTHER PUBLICATIONS

Supplementary European Search Report for EP 03706857 Date: Sep. 20, 2006.

Mashairo Yamaguchi, Taishi Terji, Kenro Ohsawa, Toshio Uchiyama, Hideto Motomuro, Yuri Murakami and Nagaaki Ohyama "Color image reproduction based on the multispectral and multiprimary imaging: Experimental evaluation", Device Independent Color, Color Hardcopy and applications VII, Proc SPIE, vol. 4663, pp. 15-26 (2002).

Yamada et al., "12.1: LED Backlight for LCDs", IBM Research, Tokyo Research Laboratory, Yamato, Japan, 1998, SID, pp. 1-4.

Keith Jack, Video Demystified, 3rd Edition, LLH Technology Publishing 2001, pp. 215-219.

Sugiura, T, "11.4: Invited Paper: EBU color Filter for LCDs", Toppan Printing Co., Japan, SID, 2001, pp. 146-149.

Horbie et al., "High Efficiency and high Visual Quality LCD Backlighting System", Faculty of Science and Technology, Kelo University, Japan, pp. 1-4.

International Search Report from PCT/IL02/00452, mailed on Dec. 9, 2002.

International Search Report from PCT/IL03/00020.

Supplementary European Search Report for EP 02 73 3203 Date: Sep. 25, 2005.

Supplementary European Search Report for EP 04 01 1262 Date: Oct. 17, 2005.

U.S. Appl. No. 09/710,895, filed Nov. 14, 2000, Ben-Chorin et al.

Ken-ichi Takatori, Hiroshi Imai, Hideki Asada and Masao Imai "Field-Sequential Smectic LCD with TFT Pixel Amplifier ", Functional Devices Research Labs, NEC Corp., Kawasaki, Kanagawa 216-8555, Japan, SID 01 Digest.

"A critical view of Spectral Models Applied to Binary Color Printing", Wyble and Berns, Color Research and Application, vol. 25, 2000, pp. 4-19.

Jeffrey A. Shimizu, "Scrolling Color LCOS for HDTV Rear Projection", SID 01 Digest, pp. 1072-1075.

Francisco H. Imai, Color Science; "Spectral reproduction from scene to hardcopy", Part 1-Multi-spectral acquisition ans spectral estimation using a Trichromatic Digital Camera System associated with absorbtion filters.

Rosen et al., "Spectral Reproduction from Scene to Hardcopy II", Image Processing. Munsell Color Science Laboratory, RIT-Proceedings of SPIE vol. 4300 (2001).

Pointer, M. R., "The Gamut of Real Surface Colors", Color Research & Appl. 5(3): 145-155, 1980.

Ajito et al., "Expanded Color Gamut Reproduced by Six-Primary Projection Display", Proc. SPIE, vol. 2954 (2000) pp. 130-137.

Ajito et al., "Multiprimary Color Display for Liquid Crystal Display Projectors Using Diffraction Granting", Optical Eng. 38(11) 1883-1888 (Nov. 1999).

Ajito et al., "Color Conversion Method for Multiprimary Display Using Matrix Switching", Optical Review, vol. 9, No. 3 (Dec. 2001), 191-197.

Gunter Wyszecki and W.S. Stiles, Color Science: Concepts and methods, Quantative Data and Formulae, 2d Ed., 1982, pp. 179-183.

Elliott et al., "13.3: Co-Optimization of Color AMLCD Subpixel Architecture and Rendering Algorithms", ClairVoyante Laboratories, USA and AMLCD, Semiconductor Business, Korea, pp. 1-4.

Elliott, C., "Active Matrix Display Layout Optimization for Subpixel Image Rendering", ClairVoyante Laboratories, USA, pp. 1-5.

Betrisey et al., "20.4: Displaced Filtering for Patterned Displays", Microsoft Corporation, Society for Information Display, 2000, SID, pp. 1-4.

Daly, Scott, "47.3: Analysis of Subtriad Addressing Algorithms by Visoal System Models" Center for Displayed Appearance, Sharp Laboratories of America, Camas, WA, USA, 2001, SID, pp. 1200-1203.

Klompenhouwer et al., "13.4: Subpixel Image Scaling for Color Matrix Displays", Phillips Research Laboratories, Einhoven, the Netherlands, 2002, SID, pp. 176-179.

Credelle et al., "9-2: MTF of High-Resolution Pen Tile Matrix Displays", Eurodisplay 2002, pp. 159-162.

Bg Platt, J., "Optimal Filtering for Patterned Displays", Microsoft Research, pp. 1-4.

Hiyama et al., "LN-3: Four-Primary Color 15-in. XGA TFT-LCD with Wide Color Gamut", Japan, Eurodisplay 2002, pp. 827-830 I I.

Sugiura et al., "P-24: LCD Module Adopting a Color Conversion Circuit", Japan, SID, 2002,pp. 288-291.

Search Report from PCT/IL03/00307, mailed on Sep. 11, 2003.

Supplementary European Search Report for Application No. EP 03 71 5317 mailed Feb. 11, 2009.

Parameter Values for the HDTV Standards for Production and International Programme Exchange, Recommendation BT.709-6 (Jun. 2015), Approved in Jun. 17, 2015.

* cited by examiner

FIG. 5A
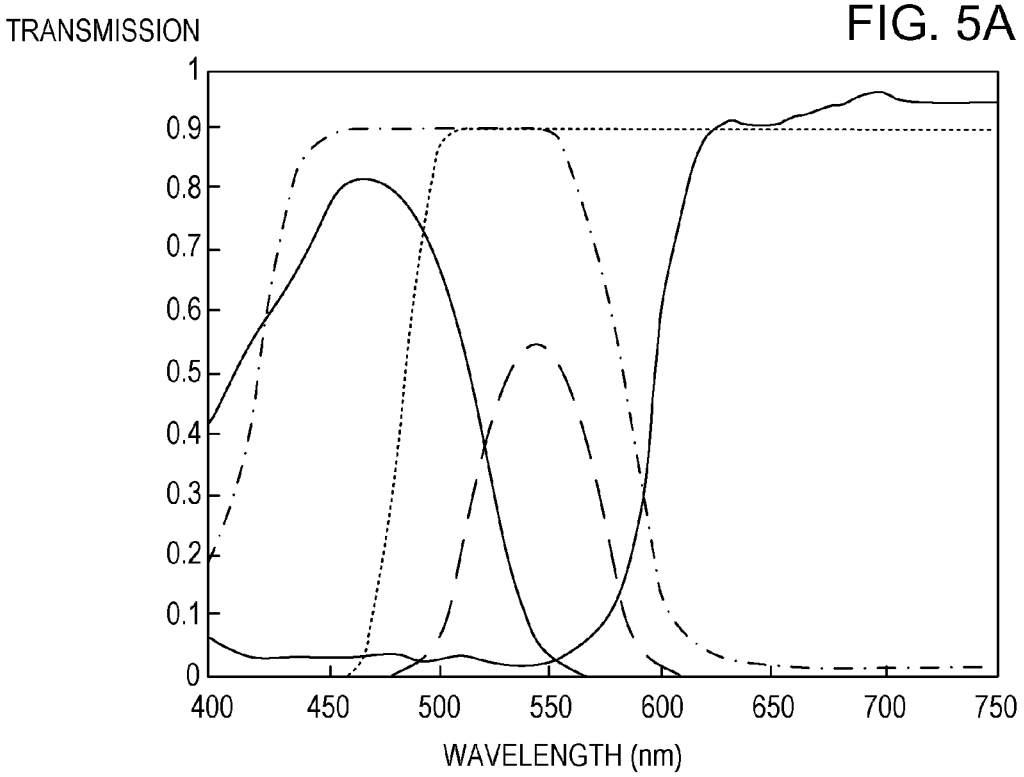
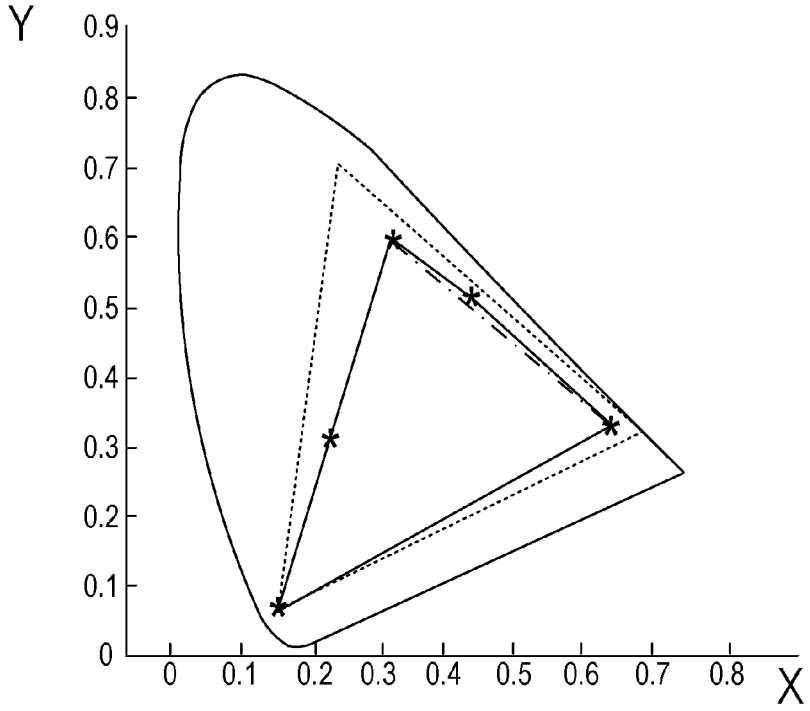
FIG. 5B

| | | | | | | | | | | | |
|---|---|---|---|---|---|---|---|---|---|---|---|
| 0 | 0 | 0 | 0 | $\frac{1}{6}$ | $\frac{1}{3}$ | $\frac{1}{3}$ | $\frac{1}{6}$ | 0 | 0 | 0 | 0 |
| 0 | 0 | 0 | $\frac{1}{6}$ | $\frac{1}{2}$ | $\frac{5}{6}$ | $\frac{5}{6}$ | $\frac{1}{2}$ | $\frac{1}{6}$ | 0 | 0 | 0 |
| 0 | 0 | $\frac{1}{6}$ | $\frac{1}{2}$ | $\frac{2}{3}$ | $\frac{2}{3}$ | $\frac{2}{3}$ | $\frac{2}{3}$ | $\frac{1}{2}$ | $\frac{1}{6}$ | 0 | 0 |
| 0 | $\frac{1}{6}$ | $\frac{1}{2}$ | $\frac{2}{3}$ | $\frac{1}{2}$ | $\frac{1}{6}$ | $\frac{1}{6}$ | $\frac{1}{2}$ | $\frac{2}{3}$ | $\frac{1}{2}$ | $\frac{1}{6}$ | 0 |

COLOR DISPLAY DEVICES AND METHODS WITH ENHANCED ATTRIBUTES

CROSS-REFERENCE TO RELATED APPLICATIONS

This application is a National Phase Application of PCT International Application No PCT/IL03/00307, International Filing Date Apr. 13, 2003, claiming priority of U.S. Provisional Patent Application 60/371,419, filed Apr. 11, 2002.

FIELD OF THE INVENTION

The invention relates generally to color display devices, systems and methods and, more particularly, to display devices, systems and methods having improved color image reproduction capability.

BACKGROUND OF THE INVENTION

Standard computer monitors and TV displays are typically based on reproduction of three, additive, primary colors ("primaries"), for example, red, green, and blue, collectively referred to as RGB. Unfortunately, these monitors cannot display many colors perceived by humans, since they are limited in the range of color they are capable of displaying. FIG. 1A schematically illustrates a chromaticity diagram as is known in the art. The closed area in the shape of a horseshoe represents the chromaticity range of colors that can be seen by humans. However, chromaticity alone does not fully represent all visible color variations. For example, each chromaticity value on the two-dimensional chromaticity plane of FIG. 1A may be reproduced at various different brightness levels. Thus, a fill representation of the visible color space requires a three dimensional space including, for example, two coordinates representing chromaticity and a third coordinate representing brightness. Other three dimensional space representations may also be defined. The points at the border of the horseshoe diagram in FIG. 1A, commonly referred to as "spectrum locus", correspond to monochromatic excitations at wavelengths ranging, for example, from 400 nm to 780 nm. The straight in "closing" the bottom of the horseshoe, between the extreme monochromatic excitation at the longest and shortest wavelengths, is commonly referred to as "the purple line". The range of colors discernible by the human eye, represented by the area of the horseshoe diagram above the purple line, at varying brightness levels, is commonly referred to as the color gamut of the eye. The dotted triangular area of FIG. 1A represents the range of colors that are reproducible by a standard RGB monitor.

There are many known types of RGB monitors, using various display technologies, including but not limited to CRT, LED, plasma, projection displays, LCD devices and others. Over the past few years, the use of color LCD devices has been increasing steadily. A typical color LCD device is schematically illustrated in FIG. 2A. Such a device includes a light source 202, an array of liquid crystal (LC) elements (cells) 204, for example, an LC array using Thin Film Transistor (TFT) active-matrix technology, as is known in the art. The device further includes electronic circuits 210 for driving the LC array cells, e.g., by active-matrix addressing, as is known in the art, and a tri-color filter array, e.g., a RGB filter array 206, juxtaposed the LC array. In existing LCD devices, each full-color pixel of the displayed image is reproduced by three sub-pixels, each sub-pixel corresponding to a different primary color, e.g., each pixel is reproduced by driving a respective set of R, G and B sub-pixels. For each sub-pixel there is a corresponding cell in the LC array. Back-illumination source 202 provides the light needed to produce the color images. The transmittance of each of the sub-pixels is controlled by the voltage applied to the corresponding LC cell, based on the RGB data input for the corresponding pixel. A controller 208 receives the input RGB data, scales it to the required size and resolution, and transmits data representing the magnitude of the signal to be delivered by the different drivers based on the input data for each pixel. The intensity of white light provided by the back-illumination source is spatially modulated by the LC array, selectively attenuating the light for each sub pixel according to the desired intensity of the sub-pixel. The selectively attenuated light passes through the RGB color filter array, wherein each LC cell is in registry with a corresponding color sub-pixel, producing the desired color sub-pixel combinations. The human vision system spatially integrates the light filtered through the different color sub-pixels to perceive a color image.

U.S. Pat. No. 4,800,375 ("the '375 patent"), the disclosure of which is incorporated herein by reference in its entirety, describes an LCD device including an array of LC elements juxtaposed in registry with an array of color filters. The filter array includes the three primary color sub-pixel filters, e.g., RGB color filters, which are interlaced with a fourth type of color filter to form predetermined repetitive sequences. The various repetitive pixel arrangements described by the '375 patent, e.g., repetitive 16-pixel sequences, are intended to simplify pixel arrangement and to improve the ability of the display device to reproduce certain image patterns, e.g., more symmetrical line patterns. Other than controlling the geometric arrangement of pixels, the '375 patent does not describe or suggest any visual interaction between the three primary colors and the fourth color in the repetitive sequences.

LCDs are used in various applications. LCDs are particularly common in portable devices, for example, the small size displays of PDA devices, game consoles and mobile telephones, and the medium size displays of laptop "notebook") computers. These applications require thin and miniaturized designs and low power consumption. However, LCD technology is also used in non-portable devices, generally requiring larger display sizes, for example, desktop computer displays and TV sets. Different LCD applications may require different LCD designs to achieve optimal results. The more "traditional" markets for LCD devices, e.g., the markets of battery-operated devices (e.g., PDA, cellular phones and laptop computers) require LCDs with high brightness efficiency, which leads to reduced power consumption. In desktop computer displays, high resolution, image quality and color richness are the primary considerations, and low power consumption is only a secondary consideration. Laptop computer displays require both high resolution and low power consumption; however, picture quality and color richness are compromised in many such devices. In TV display applications, picture quality and color richness are generally the most important considerations; power consumption and high resolution are secondary considerations in such devices.

Typically, the light source providing back-illumination to LCD devices is a Cold Cathode Fluorescent Light (CCFL). FIG. 3 schematically illustrates typical spectra of a CCFL, as is known in the art. As illustrated in FIG. 3, the light source spectra include three, relatively narrow, dominant wavelength ranges, corresponding to red, green and blue light, respectively. Other suitable light sources, as are known in the art, may alternatively be used. The RGB filters in the filter sub-pixel array are typically designed to reproduce a sufficiently wide color gamut (e.g., as close as possible to the color gamut of a corresponding CRT monitor), but also to maximize the display efficiency, e.g., by selecting filters whose transmission curves generally overlap the CCFL spectra peaks in FIG. 3. In general, for a given source brightness, filters with narrower transmission spectra provide a wider color gamut but a reduced display brightness, and vice versa. For example, in applications where power efficiency is a critical consideration, color gamut width may often be sacrificed. In certain TV applications, brightness is an important consideration; however, dull colors are not acceptable.

FIG. 4A schematically illustrates typical RGB filter spectra of existing laptop computer displays. FIG. 4B schematically illustrates a chromaticity diagram representing the reproducible color gamut of the typical laptop spectra (dashed-triangular area in FIG. 4B), as compared with an ideal NTSC color gamut (dotted triangular area in FIG. 4B). As shown in FIG. 4B, the NTSC color gamut is significantly wider than the color gamut of the typical laptop computer display and therefore, many color combinations included in the NTSC gamut are not reproducible by the typical color laptop computer display.

SUMMARY OF THE INVENTION

Many colors seen by humans are not discernible on standard red-green-blue (RGB) monitors. By using a display device with more than three primary colors, the reproducible color gamut of the display is expanded Additionally or alternatively, the brightness level produced by the display may be significantly increased. Embodiments of the present invention provide systems and methods of displaying color images on a display device, for example, a thin profile display device, such as a liquid crystal display CCD) device, using more than three primary colors.

Exemplary embodiments of an aspect of the invention provide improved multi-primary display devices using more than three sub-pixels of different colors to create each pixel. In embodiments of this aspect of the invention, the use of four or more different color sub-pixels, per pixel, allows for a wider color gamut and higher luminous efficiency. In some embodiments, the number of sub-pixels per pixel and the color spectra of the different sub-pixels may be optimized to obtain a desired combination of a sufficiently wide color gamut, sufficiently high brightness, and sufficiently high contrast.

In some embodiments of the invention, the use of more than three primary colors may expand the reproducible color gamut of the display by enabling the use of relatively narrow wavelength ranges for some of the primary colors, e.g., red, green and blue, thus increasing the saturation of those primary colors. To compensate for a potentially reduced brightness level from such narrower ranges, in some embodiments of the invention, broad wavelength range privy colors, e.g., specifically designed yellow and/or cyan, may be used in addition to the narrow wavelength range colors, thus increasing the overall brightness of the display. In further embodiments of the invention, additional primary colors (e.g., magenta) and/or different primary color spectra may be used to improve various other aspects of the displayed image. In accordance with embodiments of the invention, an optimal combination of color gamut width and over-all display brightness can be achieved, to meet the requirements of a given system, by designing specific primary colors and sub-pixel arrangements.

The color gamut and other attributes of a more-than-three primary color LCD device in accordance with embodiments of the invention may be controlled by controlling the spectral transmission characteristics of the different primary color sub-pixel filter elements used by the device. According to an aspect the invention, four or more different primary color sub-pixel filters are used, to produce four or more, respective, primary colors, for example, RGB and yellow (Y). In further embodiments of the invention, at least five different primary color sub-pixel filters are used, for example, RGB, Y and cyan (C) filters. In additional embodiments of the invention, at least six different primary color sub-pixel filters are used, for example, RGB, Y, C and magenta (M) filters.

The primary color sub-pixel filters for a more-than-three primary color LCD device in accordance with the invention may be selected in accordance with various criteria, for example, to establish sufficient coverage of a desired color gamut, to maximize the brightness level that can be produced by the display, and/or to adjust the relative intensities of the primary colors according to a desired chromaticity standard.

In accordance with embodiments of the invention, a multi-primary display with n primary colors may include an array of pixels, each pixel including n sub-pixels, wherein each sub-pixel has a predetermined aspect ratio, for example, n:1, which yields a desired aspect ratio, for example, 1:1, for each pixel.

According to farther embodiments of the invention attributes of a multi-primary LCD display may be controlled and/or affected by specific arrangements of the n sub-pixels forming each pixel and/or specific arrangements of the pixels. Such attributes may include picture resolution, color gamut wideness, luminance uniformity and/or any other display attribute that may depend on the arrangement of the pixels d/or sub-pixels.

According to one exemplary embodiment of the invention, color saturation may be improved by arranging the n primary colors in the n sub-pixels forming each pixel based on a hue order of the n primary colors.

According to another exemplary embodiment of the invention, optimal viewed image uniformity, e.g., optimally uniform luminance across the viewed image may be achieved by arranging the n primary color sub-pixels forming each pixel to yield a minimal variance in luminance between neighboring groups of sub-pixels. In some embodiments of the invention, the sub-pixel arrangement may be determined by mapping a plurality of sub-pixel arrangements, determining a luminance value of each mapped arrangement, transforming the luminance values from spatial coordinates to spatial frequencies, e.g., harmonics, for example, by applying a Fourier Transform to the calculated luminance values, and minimizing the amplitude of a harmonic, e.g., the first harmonic, of the transformation.

According to a further embodiment of the invention, the n primary sub-pixels are arranged within each pixel such that sub-sets of neighboring sub-pixels within the pixels have a relatively neutral white-balance.

According to exemplary embodiments of another aspect of the invention, there is provided a system and method for n-primary subpixel rendering of a displayed graphic object, for example, a character having a certain font The method may enable modification of the viewed contour and/or edges of the displayed graphic, for example, to reduce a color fringes effect of the viewed object. The method may include sampling the graphic image, assigning each sub-pixel an initial coverage value, applying to each sub-pixel a smoothing function, for example, calculating a weighted average of a neighboring group of sub-pixels, and assigning an adjusted coverage value to each sub-pixel in the group based on the values calculated by the smoothing function.

According to exemplary embodiments of yet another aspect of the invention, the reproducible bit-depth of a more-than-three primary color display may be expanded, i.e., a wider span of gray-levels may be obtained, compared to the bit-depth of three primary color displays, by reproducing at least some colors Bring combinations of only some of the primary color sub-pixels. This aspect of the invention may be advantageous in producing low gray-level pixels, because the variety of gray-levels may be particularly significant for the lower gray-levels. In some embodiments of this aspect of the invention, the gray-level of a pixel may be adjusted by adjusting the intensity of a sub-set of the n sub-pixels forming the pixel, for example, a sub-set capable of producing a substantially neutral white-balance.

BRIEF DESCRIPTION OF THE DRAWINGS

The invention will be understood and appreciated more fully from the following detailed description of embodiments of the invention; taken in conjunction with the accompanying drawings in which:

FIG. 5A is a schematic graph illustrating transmission curves of an exemplary, filter design for a five-primary display device in accordance with an embodiment of the invention;

FIG. 5B is a schematic illustration of a chromaticity diagram representing the color gamut of the filter design of FIG. 5A, superimposed with two exemplary prior art color gamut representations;

DETAILED DESCRIPTION OF EMBODIMENTS OF THE INVENTION

In the following description, various aspects of the invention are described, with reference to specific embodiments that provide a thorough understanding of the invention; however, it will be apparent to one skilled in the art that the present invention is not limited to the specific embodiments and examples described herein. Further, to the extent that certain details of the devices, systems and methods described herein are related to known aspects of color display devices, systems and methods, such details may have been omitted or simplified for clarity.

Figure 1A:
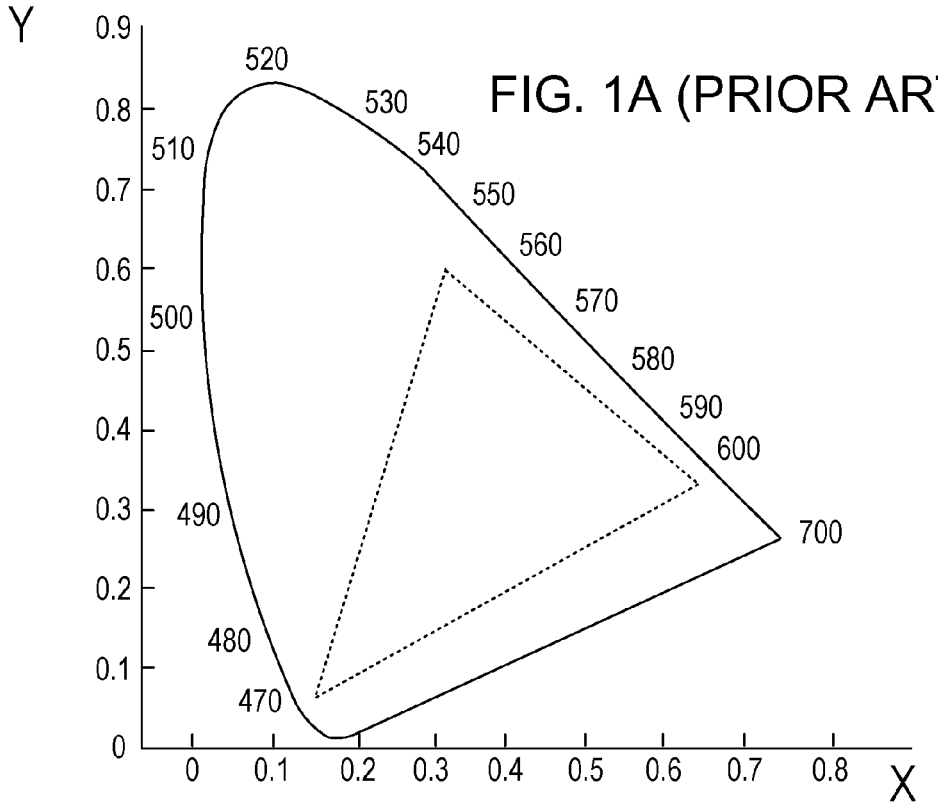
FIG. 1A (PRIOR ART)
FIG. 1A is a schematic illustration of a chromaticity diagram representing a prior art RGB color gamut, superimposed with a chromaticity diagram of the color gamut of a human vision system, as is known in the art.
Figure 1B:
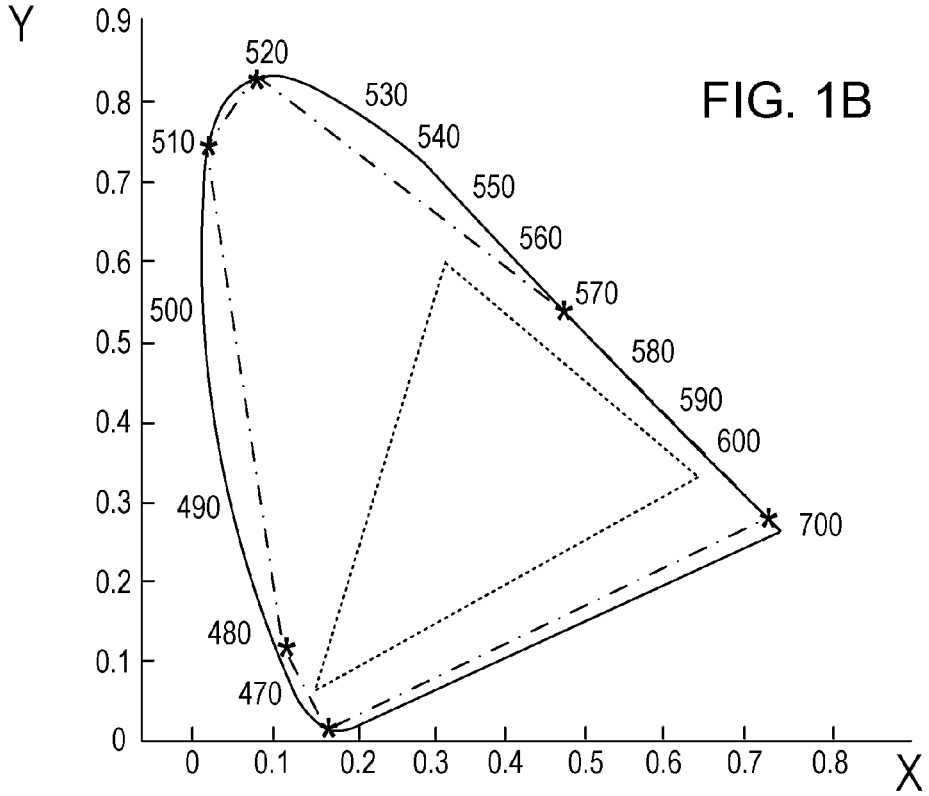
FIG. 1B is a schematic illustration of a chromaticity diagram representing a wide color gamut in accordance with an exemplary embodiment of the invention superimposed with the chromaticity diagram of FIG. 1A.

FIG. 1B schematically illustrates a color gamut of a more-than-three-primary display in accordance with an embodiment of the invention, enclosed by a horseshoe diagram representing the perceivable color gamut of the human eye, on a chromaticity plane. The six-sided shape in FIG. 1B represents the color gamut of a six-primary display in accordance with an exemplary embodiment of the invention. This color gamut is significantly wider than a typical RGB color gamut, which is represented by the dotted triangular shape in FIG. 1B. Embodiments of monitors and display devices with more than three primaries, in accordance with exemplary embodiments of the invention, are described in U.S. patent application Ser. No. 09/710,895, entitled "Device, System And Method For Electronic True Color Display", filed Nov. 14, 2000, in International Application PCT/IL01/00527, filed Jun. 7, 2001, entitled "Device, System and Method For Electronic True Color Display" and published Dec. 13, 2001 as PCT Publication WO 01/95544, in U.S. patent application Ser. No. 10/017,546, filed Dec. 18, 2001, entitled "Spectrally Matched Digital Print Proofer" and published Oct. 17, 2002 as U.S. Publication US-2002-014954, in International Application PCT/IL02/00410, filed May 23, 2002, entitled "System and method of data conversion for wide gamut displays" and published Dec. 12, 2002 as PCT Publication WO 02/99557, and in International Application PCT/IL02/00452, filed Jun. 11, 2002, entitled "Device, System and Method For Color Display" and published Dec. 19, 2002 as PCT Publication WO02/101644, the disclosures of all of which applications and publications are incorporated herein by reference.

While, in embodiments of the present invention, methods and systems disclosed in the above referenced patent applications may be used, for example, methods of converting source data to primary data, or methods of creating primary color materials or filters; in alternate embodiments, the system and method of the present invention may be used with any other suitable r-primary display technology, wherein n is greater than three. Certain embodiments described in these applications are based on rear or front projection devices, CRT devices, or other types of display devices. While the following description focuses mainly on n-primaries flat panel display devices in accordance with exemplary embodiments of the invention, wherein n is greater than three, preferably using LCDs, it should be appreciated that, in alternate embodiments, the systems, methods and devices of the present invention may also be used in conjunction with other types of display and other types of light sources and modulation techniques. For example, it will be appreciated by persons skilled in the art that the principles of the n-primary color display device of the invention may be readily implemented, with appropriate changes, in CRT displays, Plasma display, Light Emitting Diode (LED) displays, Organic LED (OLED) displays and Field Emissions Display (FED) devices, or any hybrid combinations of such display devices, as are known in the art.

Figure 2A:
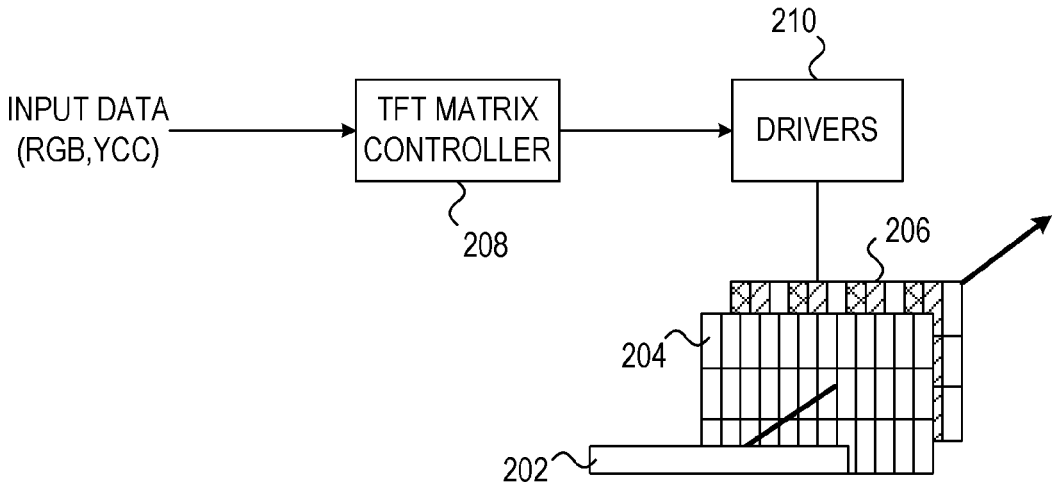
FIG. 2A (PRIOR ART)
FIG. 2A is a schematic block diagram illustrating a prior art 3-primary LCD system.
Figure 2B:
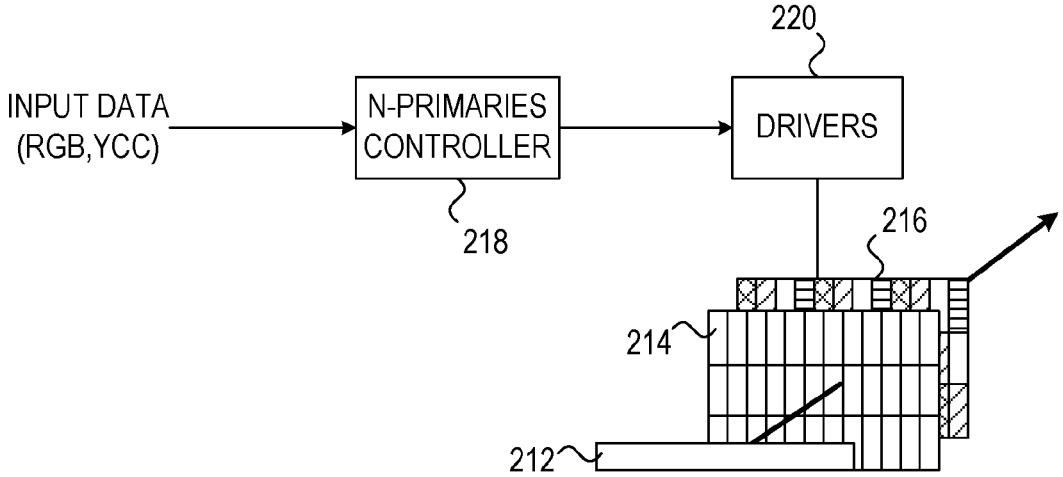
FIG. 2B is a schematic block diagram illustrating an n-primary LCD system in accordance with an embodiment of the invention.
Figure 3:
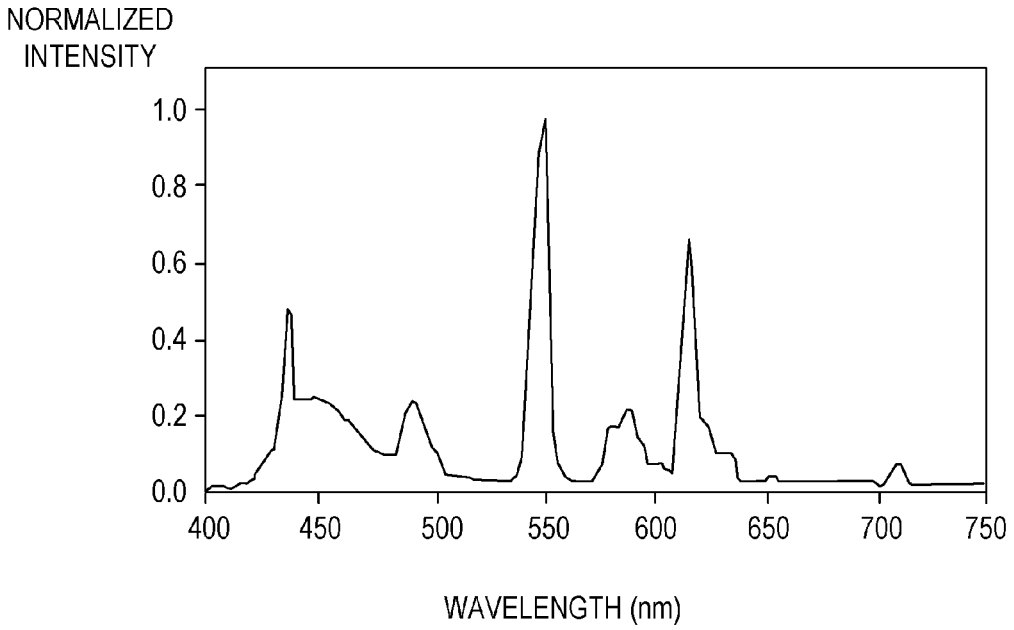
FIG. 3 (PRIOR ART)
FIG. 3 is a schematic graph illustrating typical spectra of a prior art Cold Cathode Fluorescent Light (CCFL) source.

FIG. 2B schematically illustrates a more-than-three primary color display system in accordance with an embodiment of the invention. The system includes a light source 212, an array of liquid crystal (LC) elements (cells) 214, for example, an LC array using Thin Film Transistor (TFT) active-matrix technology, as is known in the art. The device further includes electronic circuits 220 for driving the LC array cells, e.g., by active-matrix addressing, as is known in the art, and an n-primary-color filter array 216, wherein n is greater than three, juxtaposed the LC array. In embodiments of the LCD devices according to embodiments of the invention, each full-color pixel of the displayed image is reproduced by more than three sub-pixels, each sub-pixel corresponding to a different primary color, e.g., each pixel is reproduced by driving a corresponding set of four or more sub-pixels. For each sub-pixel there is a corresponding cell in LC array 214. Back-illumination source 212 provides the light needed to produce the color images. The transmittance of each of the sub-pixels is controlled by the voltage applied to a corresponding LC cell of array 214, based on the image data input for the corresponding pixel. An n-primaries controller 218 receives the input data, e.g., in RGB or YCC format, optionally scales the data to a desired size and resolution, and transmits data representing the magnitude of the signals to be delivered by the different drivers based on the input data for each pixel. The intensity of white light provided by back-illumination source 212 is spatially modulated by elements of the LC array, selectively controlling the illumination of each sub-pixel according to the image data for the sub-pixel. The selectively attenuated light of each sub-pixel passes through a corresponding color filter of color filter array 216, thereby producing desired color sub-pixel combinations. The human vision system spatially integrates the light filtered through the different color sub-pixels to perceive a color image.

The color gamut and other attributes of LCD devices in accordance with embodiments of the invention may be controlled by a number of parameters. These parameters include: the spectra of the back illumination element (light source), for example a Cold Cathode Fluorescent Light (CCFL); the spectral transmission of the LC cells in the LC array; and the spectral transmission of the color filters. In a 3-primaries display, the first two parameters, namely, the spectra of the light source and the spectral transmission of the LC cell are typically dictated by system constraints and, therefore, the colors for the filters may be selected straightforwardly to provide the required colorimetric values at the "corners" of the desired RGB triangle, as shown in FIG. 1A. To maximize the efficiency of 3-primaries LCD devices, the spectral transmissions of the filters are designed to substantially overlap, to the extent possible, with the wavelength peaks of the light source. The filters selection in 3-primary LCD devices may be based primarily on maximizing the overall brightness efficiency. In this context it should be noted that selecting filters having narrower spectral transmission curves, which result in more saturated primary colors, generally decreases the over-all brightness level of the display.

For a multi-primary display with more than three primary colors, in accordance, with embodiments of the invention, an infinite number of filter combinations can be selected to substantially overlap a required color gamut. The filter selection method of the invention may include optimizing the filter selection according to the following requirements: establishing sufficient coverage of a desired two-dimensional color gamut, for example, the NTSC standard gamut for wide-gamut applications and a "conventional" 3-color LCD gamut for higher brightness applications; maximizing the brightness level of a balanced white point that can be obtained from combining all the primary colors; and adjusting the relative intensities of the primary colors in accordance with a desired illumination standard, e.g., the D65 white point chromaticity standard of High Definition TV (HDTV) systems.

Embodiments of the present invention provide systems and methods of displaying color images on a display device, for example, a thin profile display device, such as a liquid crystal display (LCD) device, using more than three colors. A number of embodiments of the invention are described herein in the context of an LCD device with more than three primary colors; wherein the number of color filters used per pixel is greater than three. This arrangement has several advantages in comparison to conventional RGB display devices. First, the n-primary display device in accordance with the invention enables expansion of the color gamut covered by the display. Second, the device in accordance with the invention enables a significant increase in the luminous efficiency of the display; in some cases, an increase of about 50 percent or higher may be achieved, as discussed below. This feature of the invention is particularly advantageous for portable (e.g., battery-operated) display devices, because increased luminous efficiency may extend the usable time of a battery after each recharging and/or reduce the overall weight of the device by using a lighter battery. Third, a device in accordance with the invention enables improved graphics resolution by efficient utilization of a technique for arranging primary colors in sub-pixels, as described in detail below with reference to specific embodiments of the invention.

In some multi-primary display devices in accordance with embodiments of the invention, more than three sub-pixels of different colors are used to create each pixel. In embodiments of the invention, the use of four or more different color sub-pixels, per pixel allows for a wider color gamut and higher luminous efficiency. In some embodiments, the number of sub-pixels per pixel and the transmittance spectrum of the different sub-pixel filters may be optimized to obtain a desired combination of a sufficiently wide color gamut sufficiently high brightness, and sufficiently high contrast.

For example, the use of more than three primaries in accordance with an embodiment of the invention may enable expansion of the reproducible color gamut by enabling the use of filters with narrower transmission curves (e.g., narrower effective transmission ranges) for the R, G and B color filters and, thus, increasing the saturation of the R, G and B sub-pixels. To compensate for such narrower ranges, in some embodiments of the invention, broader band sub-pixel filters may be used in addition to the RGB saturated colors, thus increasing the overall brightness of the display. In accordance with embodiments of the invention, an optimal combination of color gamut width and over-all picture brightness can be achieved, to meet the requirements of a given system, by appropriately designing the sub-pixel filters of the n-primary display and the filter arrangement.

Figure 5C:
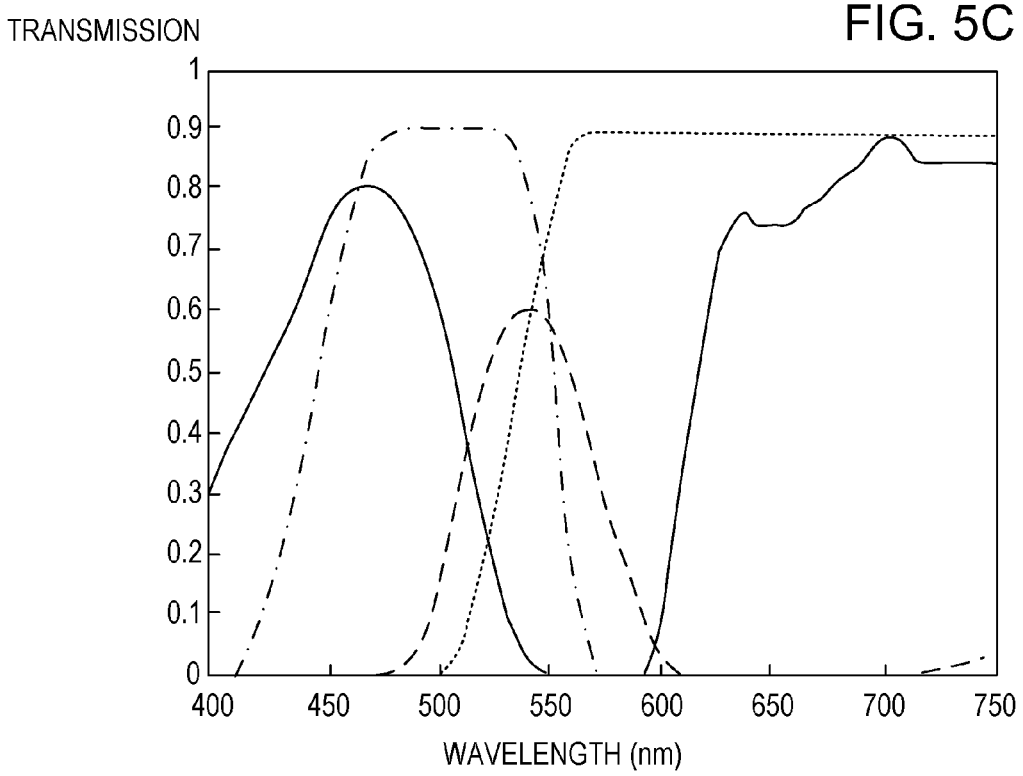
FIG. 5C is a schematic graph illustrating transmission curves of another, exemplary, filter design for a five-primary display device in accordance with an embodiment of the invention.
Figure 5D:
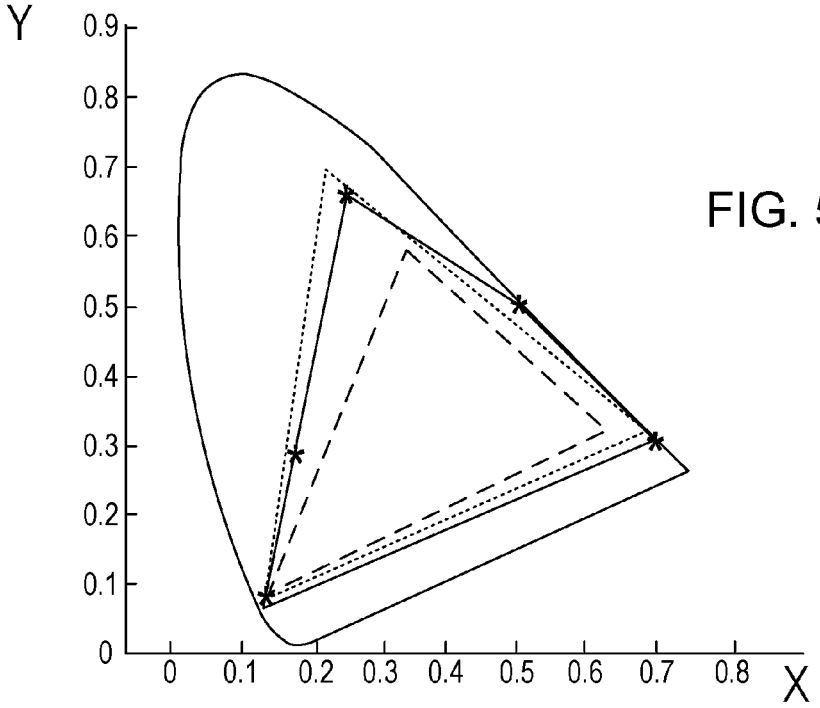
FIG. 5D is a schematic illustration of a chromaticity diagram representing the color gamut of the filter design of FIG. 5C, superimposed with two exemplary prior art color gamut representations.

FIGS. 5A and 5C schematically illustrate transmission curves for two, respective, alternative designs of a five-primary display device in accordance with embodiments of the invention, wherein the five primary colors used are red (R), green (G), blue (B), cyan (C) and yellow (Y), denoted collectively RGBCY. FIGS. 5B and 5D schematically illustrate the resulting color gamut of the filter designs of FIGS. 5A and 5C, respectively. It will be appreciated that both designs produce wider gamut coverage and/or higher brightness levels than corresponding conventional three-color LCD devices, as discussed in details below. As known in the ark the normalized over-all brightness level of a conventional 3-color LCD may be calculated as follows:

$$Y(\text{3-colors})=(Y(\text{color}_1)+Y(\text{color}_2)+Y(\text{color}_3))/3$$

In an analogous manner, the normalized brightness level of a 5-color LCD device in accordance with an embodiment of the present invention may be calculated as follows:

$$Y(\text{5-colors})=(Y(\text{color}_1)+Y(\text{color}_2)+Y(\text{color}_3)+Y(\text{color}_4)+Y(\text{color}_5))/5$$

wherein $Y(\text{color}_1)$ denotes the brightness level of the i'th primary color and Y(n-colors) denotes the over-all, normalized, brightness level of the n-primaries display.

Figure 4A:
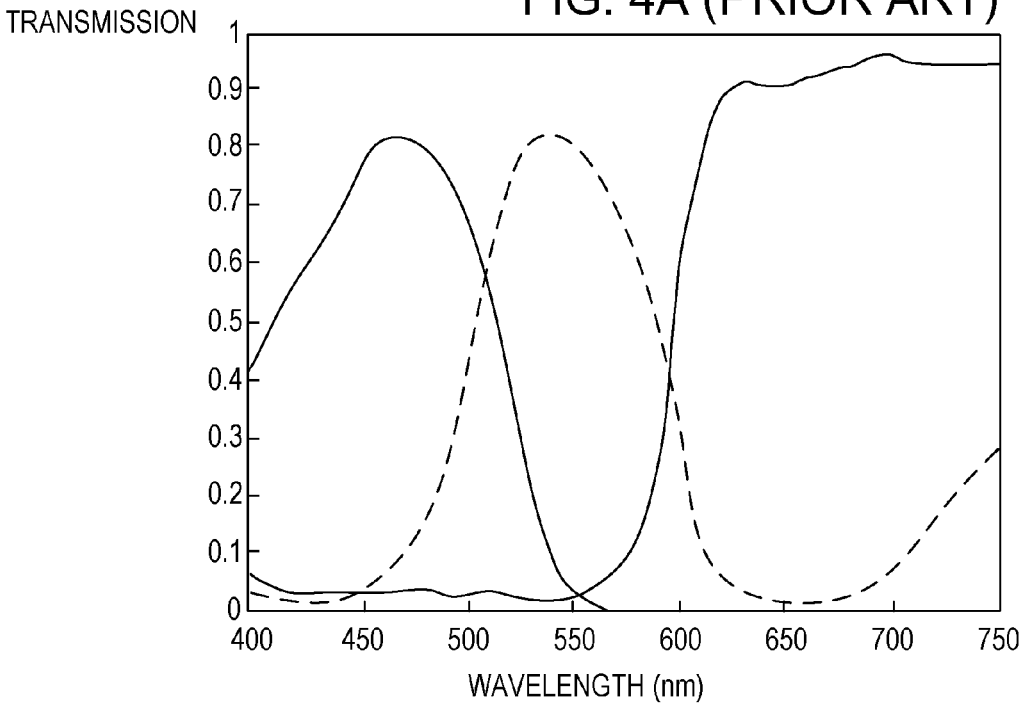
FIG. 4A (PRIOR ART)
FIG. 4A is a schematic graph illustrating typical RGB filter spectra of a prior art laptop computer display.
Figure 4B:
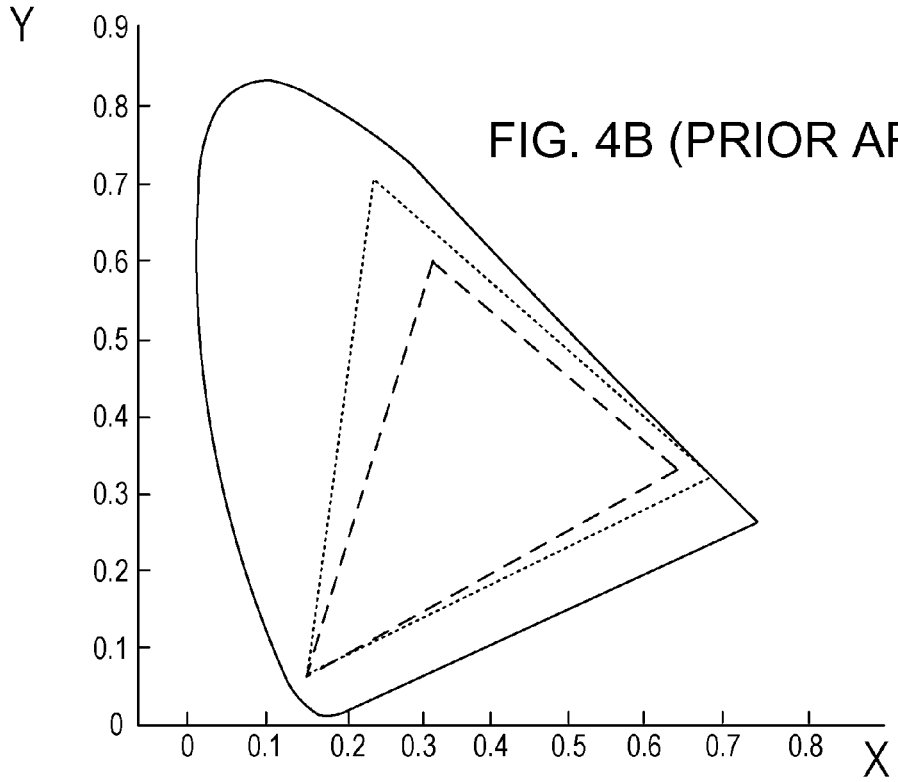
FIG. 4B (PRIOR ART)
FIG. 4B is a schematic illustration of a chromaticity diagram representing the color gamut reproduced by the prior art RGB filter spectra of FIG. 4A, superimposed with an ideal prior art NTSC color gamut.

Although the color gamut illustrated in FIG. 5B is comparable with that of a corresponding 3-color LCD device (FIG. 4B), the brightness level that can be obtained using the filter design of FIG. 5A is about 50% higher than that of the corresponding 3-color LCD. The higher brightness levels achieved in this embodiment are attributed to the addition of yellow (Y) and cyan (C) color sub-pixels, which are specifically designed to have broad transmission regions and, thus, transmit more of the back-illumination than the RGB filters. This new filter selection criterion is conceptually different from the conventional selection criteria of primary color filters, which are typically designed to have narrow transmission ranges. The white point chromaticity coordinates for this embodiment, as calculated from the transmission spectra and the back-illumination spectra using methods known in the known art are x=0.318; y=0.352.

As shown in FIG. 5D, the color gamut for the filter design of FIG. 5C is considerably wider than that of the corresponding conventional 3-color LCD (FIG. 4B), even wider than a corresponding NTSC gamut, which may be the reference gamut for color CRT devices, with brightness levels roughly equal to those of a 3-color LCD. In this embodiment, the over-all brightness level of the 5-color LCD device may be similar to that of a 3-color LCD device having a much narrower color gamut. The white point coordinates for this embodiment, as calculated from the transmission spectra and the back-illumination spectra using methods known in the known art, are x=0.310; y=0.343.

Other designs may be used in embodiments of the invention, including the use of different primaries and/or additional primaries (e.g., 6 color displays), to produce higher or lower brightness levels, a wider or narrower color gamut, or any desired combination of brightness level and color gamut, as may be suitable for specific applications.

Figure 6:
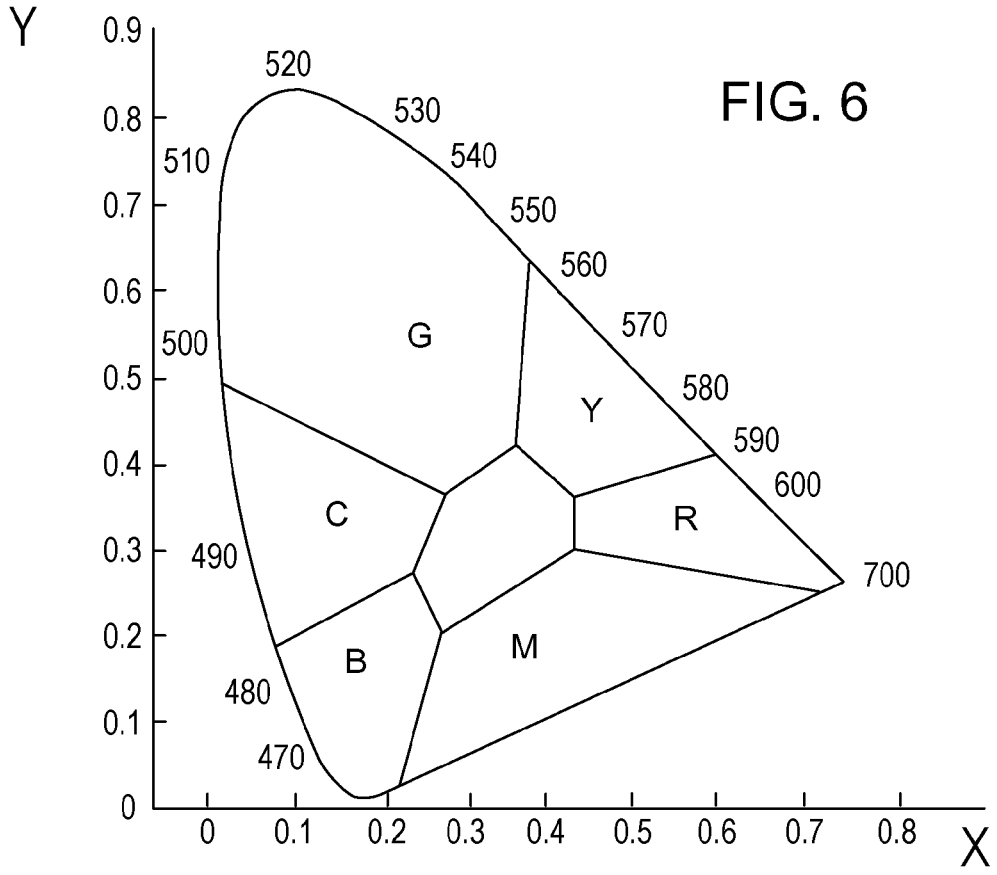
FIG. 6 is a schematic illustration of a chromaticity diagram of a human vision color gamut divided into a plurality of color sub-gamut regions.

FIG. 6 schematically illustrates a chromaticity diagram of the color gamut discernable by humans, divided into six sub-gamut regions, namely red (R), green (G), blue (B), yellow (Y), magenta (M) and cyan (C) color sub-gamut regions, that may be used for selecting effective color filters spectra in accordance with embodiments of the invention. In some embodiments, more than three primary color filters, for example, five color filters as in the embodiments of FIG. 5A may be selected to produce chromaticity values within respective sub-gamut regions in FIG. 6. The exact chromaticity position selected for a given primary color within a respective sub-gamut region may be determined in accordance with specific system requirements, for example, the desired width of the color gamut in the chromaticity plane and the desired image brightness. As discussed in detail above, the system requirements depend on the specific device application, e.g., certain applications give preference to gamut size, while other applications give preference to image brightness. The sub-gamut regions in FIG. 6 represent approximated boundaries from which primary colors may be selected to provide large gamut coverage and/or high brightness levels, while maintaining a desired white point balance, in accordance with embodiments of the invention. The positions of the primary chromaticity values within the sub-gamut regions of FIG. 6, for given filter spectra selections and known back-illumination spectra, can be calculated using straightforward mathematical calculations, as are known in the art, to determine whether a desired color gamut is obtained for the given filter spectra selections.

In accordance with embodiments of the invention, a multi-primary display with n primary colors may include an array of pixels, each pixel including n sub-pixels, wherein each sub-pixel has a predetermined aspect ratio, for example, n:1, which yields a desired aspect ratio, for example, 1:1, for each pixel.

Figure 7A:
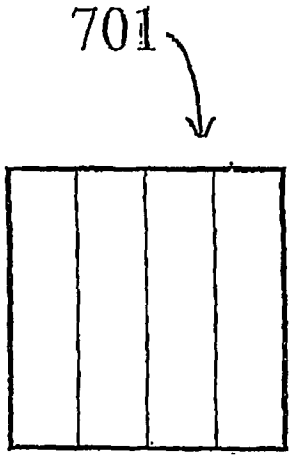
FIGS. 7A, 7B and 7C are schematic illustrations of one-dimensional configurations of sub-pixels of an n-primary LCD display in accordance with exemplary embodiments of the invention.
Figure 7B:
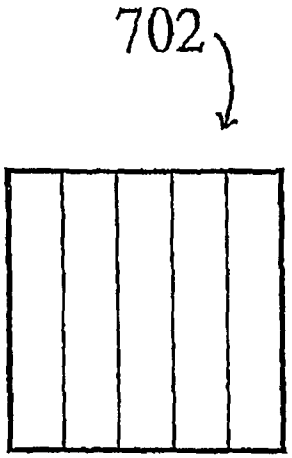
Figure 7C:
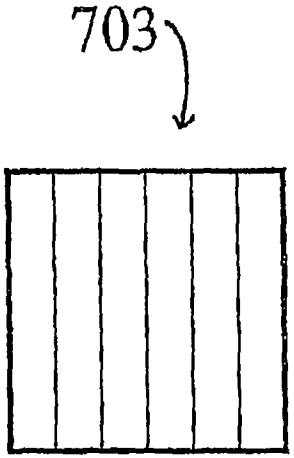

The sub-pixels in each pixel may be configured in a one dimensional or a two-dimensional array. FIGS. 7A, 7B and 7C illustrate one-dimensional configurations of sub-pixels in a pixel of an n-primary LCD display in accordance with exemplary embodiments of the invention. The configurations illustrated in FIGS. 7A, 7B and 7C are one dimensional in the sense Eat all the sub-pixels of each pixel are configured in a single linear sequence.

Figure 7E:
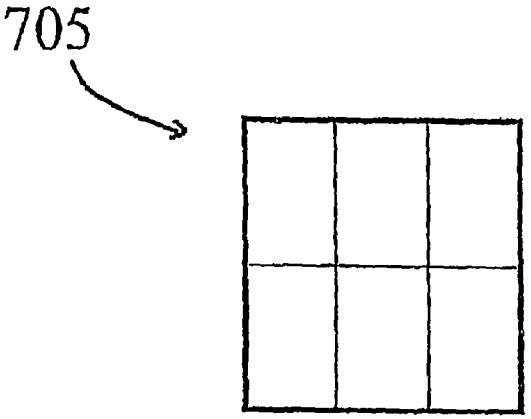
FIGS. 7D and 7E are schematic illustrations of two-dimensional configurations of sub-pixels of an n-primary LCD display in accordance with exemplary embodiments of the invention.
Figure 7D:
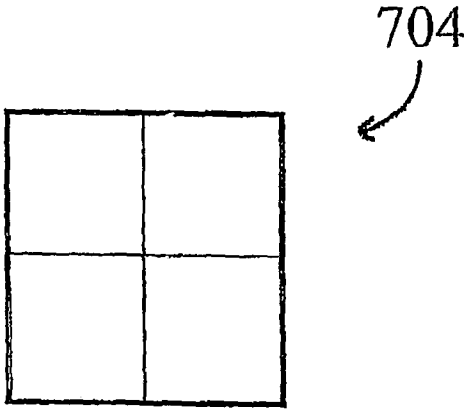

If n is not a prime number, i.e., if $n=1*k$ wherein $k\neq1$ and $1\neq1$ are integers, it is possible to configure the sub-pixels in two-dimensional configurations, e.g., in 1 rows and k columns. FIGS. 7D and 7E schematically illustrate two-dimensional configurations of sub-pixels in a pixel of an n-primary LCD display, in accordance with exemplary embodiments of the invention.

For example, as shown in FIGS. 7A-7E, sub-pixels of a 5-primary display may have a one-dimensional configuration 702, whereas sub pixels of 4-primary or 6-primary displays may be configured either in one-dimensional configurations, e.g., 701 and 704, respectively, or in two-dimensional configurations, e.g., 703 and 705, respectively.

According to embodiments of the invention, some of the attributes of an n-primary LCD display may be related to the arrangement of the n sub-pixels forming each pixel as described hereinafter. Such attributes may include, for example, image resolution, color saturation, viewed luminance uniformity, and/or any display attribute that may be affected by sub-pixel arrangements described herein.

According to an exemplary embodiment of the invention, desired color saturation may be achieved by arranging the n primary colors forming each pixel based on a hue order of the individual a primary colors. In this context, the hue order may be based on the circumferential sequence of the individual n primary colors on a chromaticity diagram, for example, the horseshoe diagram illustrated in FIG. 1B. Light of each display sub-pixel may be transmitted through a corresponding color filter. However, due to light scattering and reflection effects, the light may also "leak" through the color filters of neighboring sub-pixels. This may result in distortion or reduction of the desired color saturation. For example, if neighboring sub-pixels reproduce complementary primary colors, light leakage between the sub-pixels may reduce the effective color saturation of the sub-pixels due to a certain degree of neutral color viewed from the combination of complementary colors. It should be noted that the effect of light leakage from one sub-pixel to another may depend on the length of the border between the sub-pixels as well as the distance between the sub-pixels, e.g., the leakage of light may be reduced as the distance between the centers of neighboring sub-pixels is increased. For example, vertically or horizontally neighboring sub-pixels, e.g., on the same row or on the same column, may be more susceptible to leakage than two diagonally neighboring sub-pixels. Furthermore, neighboring pixels on rows and columns may produce different leakage effects depending on the aspect ratio of the sub-pixels.

In order to avoid the viewed leakage effect described above, arrangements of sub-pixels according to exemplary embodiments of the invention may be designed to maximize the distance between sub-pixels of complementary primary colors and/or partly complementary sub-pixels. An arrangement of sub-pixels according to hue order in accordance with exemplary embodiments of the invention may minimize the effect of light leakage from one sub-pixel to another and, thus, increase the color saturation and minimize distortion of entire pixels.

Figure 8B:
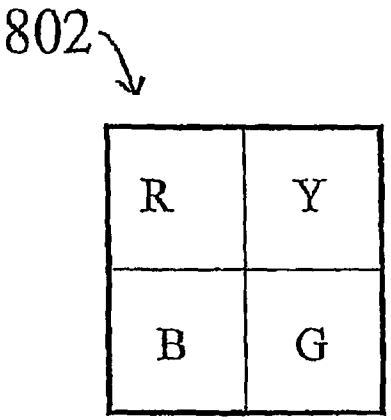
FIGS. 8A and 8B are schematic illustrations of arrangements of primary colors in groups of sub-pixels based on hue order of the n primary colors, for a one-dimensional 5-primary display and for a two-dimensional 4-primary display, respectively, in accordance with exemplary embodiments of the invention.
Figure 8A:
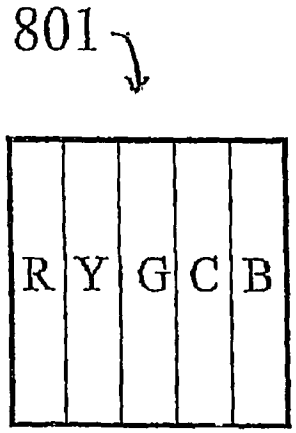

FIGS. 8A and 8B schematically illustrate arrangements 801 and 802, respectively, of primary colors in sub-pixels based on the hue order of primary colors, for a one-dimensional 5-primary display and for a two-dimensional 4-primary display, respectively, in accordance with exemplary embodiments of the invention. The 5 sub-pixels in arrangement 801 of the 5-primary display are arranged according to hue order, e.g., RYGCB. This arrangement implies that potential leakage of light from each sub-pixel to a neighboring sub-pixel may only slightly shift the hue of the color represented by the entire pixel without significantly affecting the color saturation of the pixel. It will be appreciated that, in contrast to arrangements 801 and 802, for example, if the yellow and blue colors were to be arranged in neighboring sub-pixels, such as in a RYBGC arrangement, even a small light leakage from one sub-pixel to a neighboring sub-pixel would have caused a large reduction in saturation of the entire pixel. In the exemplary case of the two-dimensional arrangement 802 of the 4-primary display, the blue and yellow sub pixels are located on one diagonal and the red and green sub-pixels are located on another diagonal, thus creating an arrangement wherein each color sub-pixel directly neighbors only sub-pixels with relatively close hues, e.g., the yellow color sub-pixel may directly neighbor the red and green color sub-pixels. It should be noted that the exemplary arrangements shown and described herein are demonstrative only. It will be appreciated by persons skilled in the art that other suitable arrangements of the sub-pixels, wherein each sub-pixel neighbors other sub-pixels based on hue values, are also within the scope of the invention.

According to another exemplary embodiment of the invention, to improve the viewed spatial uniformity of an image, viewed variations in the brightness of a spatially uniform image may be reduced by appropriately arranging the n primary color sub-pixels internally within each pixel, as follows.

Figure 9A:
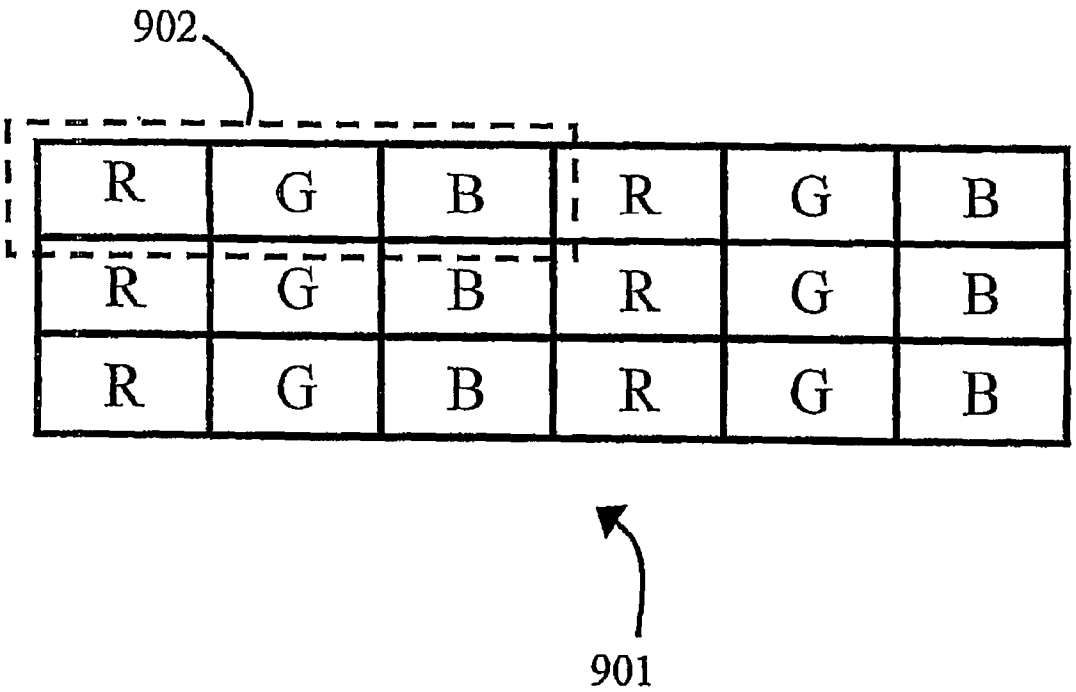
Fig. 9A (Prior Art)
FIGS. 9A and 9B are schematic illustrations of prior art arrangements of sub-pixels in a RGB display.
Figure 9B:
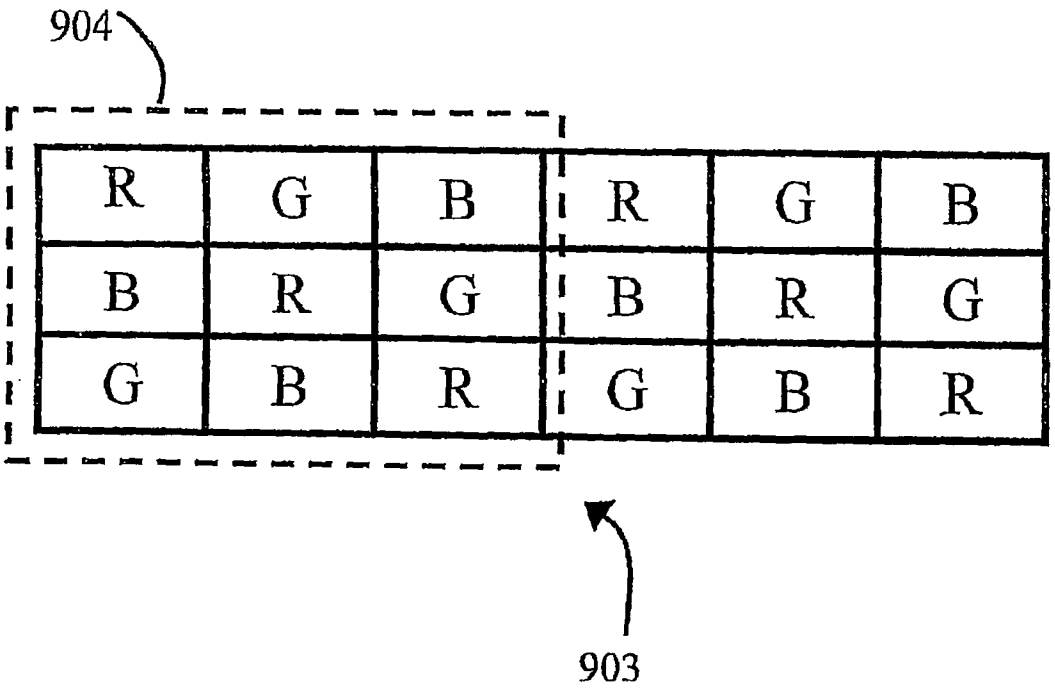
Fig. 9B (Prior Art)

According to exemplary embodiments of the invention, an array of pixels forming the LCD display may be brokendown into a plurality of identical basic repeating units. A basic repeating unit may contain a configuration and/or arrangement of one or more pixels, or a predefined combination of sub-pixels, which is repeated throughout the array of sub-pixels forming display. FIGS. 9A and 9B illustrate arrangements of sub-pixels including a basic repeating unit in a RGB LCD display, in accordance with exemplary embodiments of the invention. In a conventional arrangement 901 of pixels of a RGB LCD display, for example, a red sub-pixel may occupy the same position in different rows, such that the order of sub-pixels in each row may be R-G-B. The basic repeating unit in this exemplary arrangement represents one RGB pixel 902. In another exemplary RGB arrangement 903, a first row of the display may include R-G-B sub-pixel arrangements, a second row may include B-R-G sub-pixel arrangements, a third row may include G-B-R sub-pixel arrangements, and a forth row may again include the R-G-B sub-pixel arrangements. In this case, a basic repeating unit 904 may include three pixels, one directly below the other.

A similar approach may be used for a more-than-three primary display wherein the sub-pixels are configured in one-dimensional or two-dimensional configurations as described above. For a two dimensional sub-pixel configuration, the relationships between sub-pixel colors in neighboring pixels on different rows as well as the relationships between sub-pixel colors in neighboring pixels of the same row may be analyzed in an analogous manner.

Figure 9C:
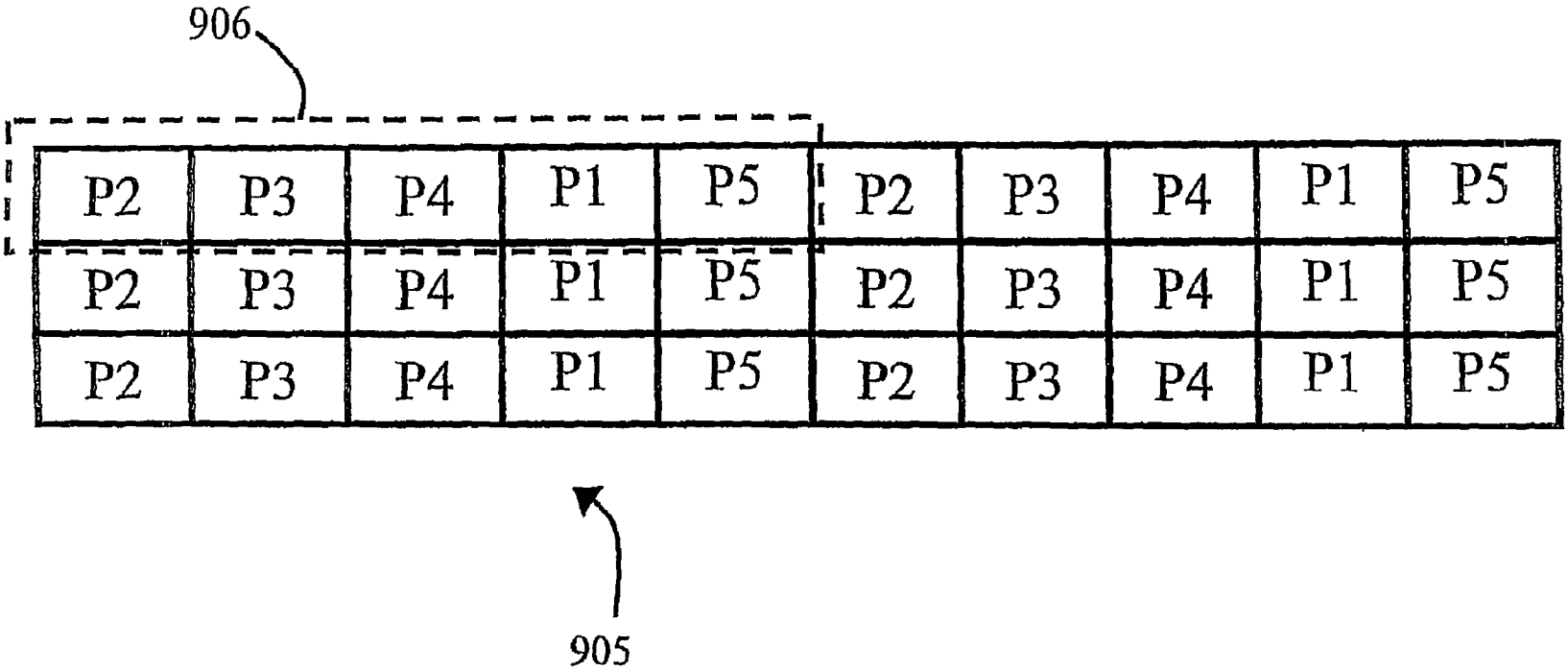
FIG. 9C is a schematic illustration of an arrangement of sub-pixels including a basic repeating unit having a one-dimensional 5-primary configuration in accordance with an exemplary embodiment of the invention.

FIG. 9C schematically illustrates an arrangement 905 of sub-pixels including a basic repeating unit 906 having a one-dimensional 5-primary configuration in accordance with an exemplary embodiment of the invention.

Luminance values of the primary colors may depend on a set of primary color filters and the type of backlight used by the display. Different filters and light sources may provide different primary color luminance values; therefore, the methods described herein for arranging the sub-pixels may yield sub-pixel arrangements for achieving optimal luminance uniformity for a given combination of backlight and filters.

According to an exemplary embodiment of the invention, a 5-primary display may include a set of five primary colors, denoted P1, P2, P3, P4 and P5, having luminance values of for example, 0.06, 0.13, 0.18, 0.29 and 0.34, respectively. According to this exemplary embodiment of the invention, there may be 24 different one dimensional arrangements of the primary colors. To determine an optimal arrangement of the sub-pixels, in an embodiment of the invention, a function transforming spatial coordinates to spatial frequencies, e.g., harmonics, for example, a Fourier Transform, may be applied to each arrangement, and the amplitude of the first harmonic of the transformation may be analyzed as a criterion for choosing an optimal arrangement. For example, a Fourier Transform analysis as described with reference to FIG. 10 below indicates that a relatively low first harmonic amplitude may be obtained for an arrangement of the 5 primary colors in unit 906 in the order P2-P3-P4-P1-P5, as shown schematically in FIG. 9C, as well as for an arrangement of the primary colors in the order P2-P5-P1-P4-P3 (not shown). According to this exemplary embodiment of the invention, either one of the optimal arrangements, namely, P2-P3-P4-P1-P5 or P2-P5-P1-P4-P3, may be chosen to optimize further required display attributes, e.g., image brightness, color saturation, image resolution, or any other relevant display attribute.

Figure 10:
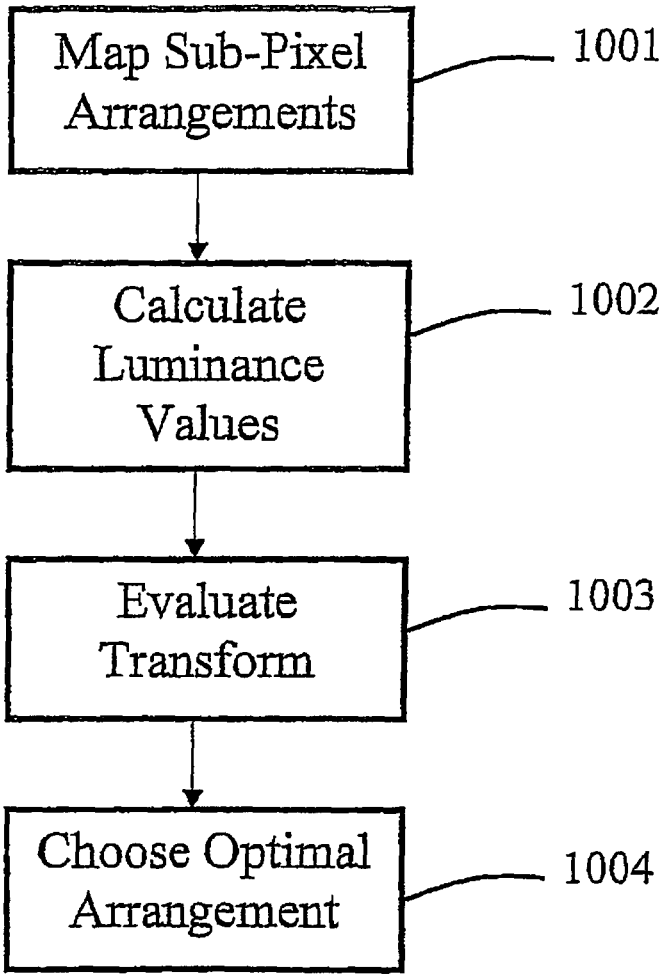
FIG. 10 is a schematic block-diagram illustration of a method for arranging n primary colors in groups of n sub-pixels of a LCD display in accordance with exemplary embodiments of the invention.

FIG. 10 is a schematic block-diagram illustrating a method for arranging n primary color sub-pixels within a pixel of a LCD display in accordance with exemplary embodiments of the invention.

The method may include mapping all possible arrangements of the n primary colors to the n sub-pixels for a selected sub-pixel configuration, as indicated at block 1001.

As indicated at block 1002, the known luminance values of each of the primary colors are used to calculate a set of luminance values as a function of sub-pixel position for each of the mapped sub-pixel arrangements of block 1001.

As indicated at block 1003, a transformation function, for example, a Fourier Transform of the position-dependent luminance values calculated at block 1002, may be calculated.

Since the eye is more sensitive to contrast variations at low spatial frequencies, the amplitude of the first harmonic of the transform may be analyzed for all arrangements, to select arrangements with a relatively small amplitude of the first harmonic, as indicated at block 1004.

According to alternative embodiments of the invention, block 1004 may include further operation techniques, for example, since the sensitivity of the eye may be different in different directions, the selection of an optimal arrangement may also be based on the direction of variation of the first harmonic.

According to exemplary embodiments of the invention, a computer running suitable software, or any other suitable combination of hardware and/or software, may be used to perform the method described above.

According to a further embodiment of the invention, the primary colors may be arranged in sub-pixels in a combination wherein each su-set of neighboring sub-pixels within a pixel may have a substantially neutral white-balance, i.e., each sub-set may be capable of producing light as close as possible to white light. An advantage of this arrangement is that it may enable high-resolution rendering of black-and-white images, for example, images of characters, e.g., black text over white background.

Figure 11B:
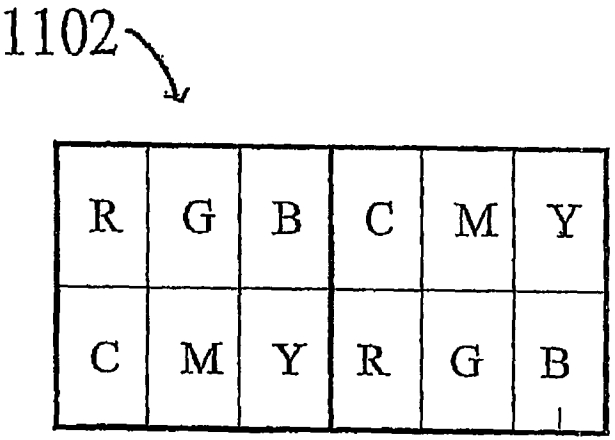
FIG. 11B is a schematic illustration of an arrangement of primary colors in sub-pixels for a two-dimensional 6-primary display, in accordance with an exemplary embodiment of the invention.
Figure 11A:
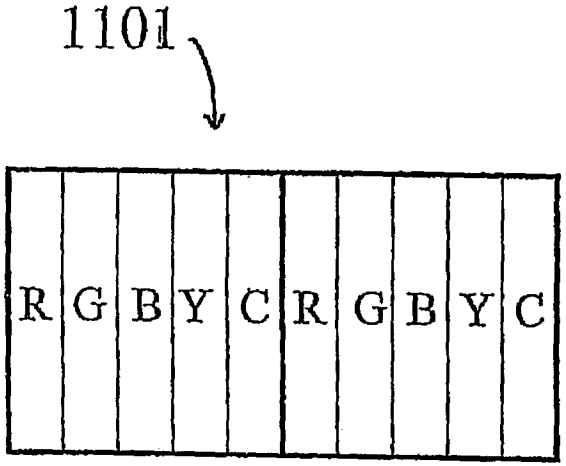
FIG. 11A is a schematic illustration of an arrangement of primary colors in sub-pixels for a one-dimensional 5-primary display, in accordance with an exemplary embodiment of the invention.

FIGS. 11A and 11B illustrate an assignment of primary colors to sub-pixels, wherein each sub-set of neighboring sub-pixels win a pixel may have a relatively neutral white-balance, in accordance with an exemplary embodiment of the invention.

In the 5-primary one-dimensional configuration illustrated in FIG. 11A, the primary color subpixels are arranged in a RGBYC arrangement 1101, including RGB, GBY, BYC, YCR and CRC triad sub-sets.

Figure 11C:
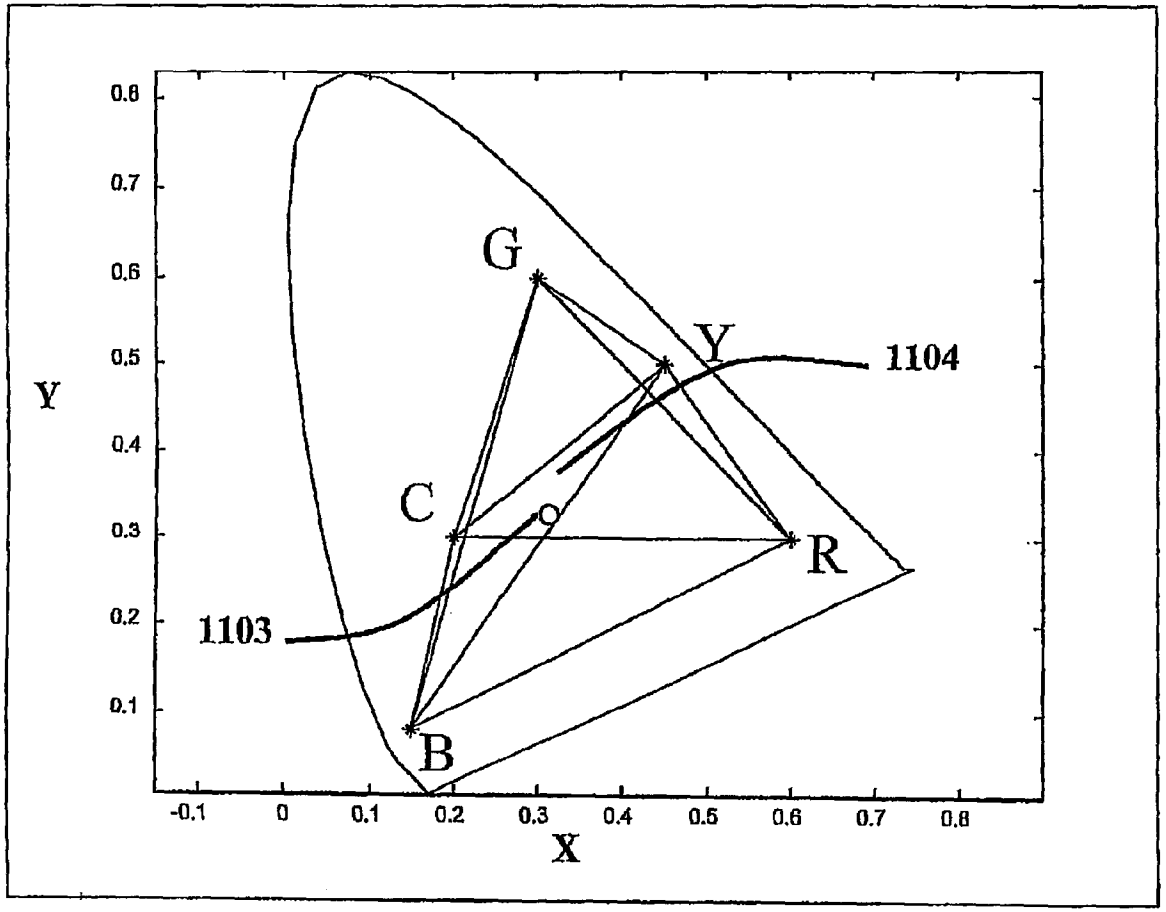
FIG. 11C is a schematic illustration of a chromaticity diagram representing the color gamut of a 5-primary display in accordance with an exemplary embodiment of the invention.

FIG. 11C is a schematic illustration of a chromaticity diagram representing a color gamut of a 5-primary display in accordance with an exemplary embodiment of the invention. It will be appreciated that the color gamut produced by each of the triads listed above includes an area 1104, which contains a D65 white point 1103, and thus may produce light very close to white light Therefore, the arrangement of sub-pixels according to arrangement 1101 may increase the effective luminance resolution of the display by a factor of 5/3 compared to the luminance resolution that may be achieved by a 5-primary display without the specific sub-pixel arrangement described herein. In the 6-primary two-dimensional configuration illustrated in FIG. 11B, arrangement 1102 of the primary colors is preformed for two neighboring pixels, wherein the first row may include the combination RGBCMY and the second row may include the combination CMYRGB. Each combination includes the triads RGB and CMY, which may each produce substantially white light. This arrangement farther creates in each one of the columns desirable sub-combinations, e.g., sub-pixel pairs RC, GM and YB. These sub-combinations may include pairs of complementary colors, which may each produce substantially white light. It will be appreciated that the arrangement of FIG. 11B may increase the resolution of the display by a factor of about 3 in the horizontal direction and by a factor of about two in the vertical direction compared to a luminance resolution achieved by a 6-primary display without the sub-pixel arrangements described herein.

Another embodiment of the invention relates to a method of n-primary sub-pixel rendering of a displayed graphic object, for example, a character of a text font. When displaying a graphic object on a screen, resolution may be an important factor, especially when extrapolation or interpolation methods are used to resize graphic objects to a given screen resolution. For example, when a relatively small graphic object is enlarged, using up-scaling methods as are known in the art, to display a relatively large image of the graphic object, the clarity of the enlarged image may be impaired because of inaccurate extrapolation of data to create new pixels. This problem may be particularly apparent at or near the edges of a displayed graphic object, e.g., along the contour of the graphic object.

Figure 12C:
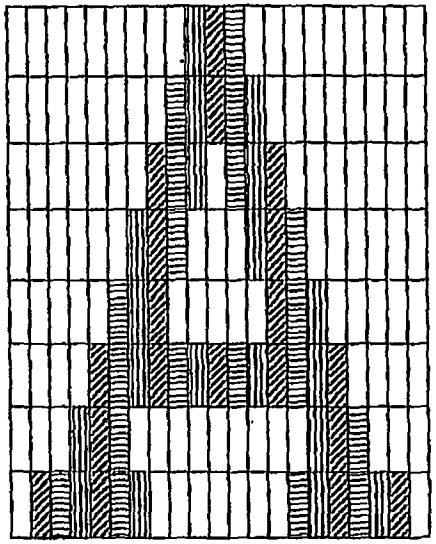
FIG.12C PRIOR ART
FIG. 12C is a schematic illustration of an enlarged character rastered to RGB sub-pixels according to prior art methods.
Figure 12B:
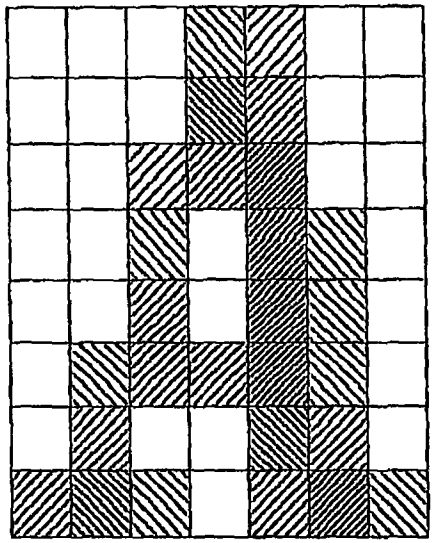
FIG.12B PRIOR ART
FIG. 12B is a schematic illustration of an enlarged character rastered to gray-scale pixels according to prior art methods.
Figure 12A:
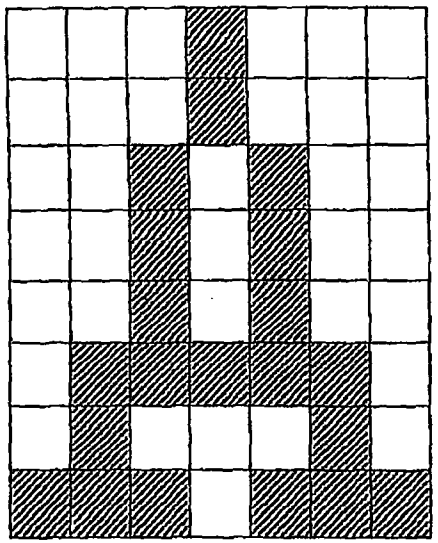
FIG.12A PRIOR ART
FIG. 12A is a schematic illustration of an enlarged character rastered to black and white pixels according to prior art methods.

FIG. 12A illustrates an enlargement of the letter "A" when rastered to be displayed using black and white pixels. The letter illustrated in FIG. 12A may not be easily readable because of its low resolution.

FIG. 12B illustrates an enlargement of the letter "A" using gray-scale pixel rendering.

In order to improve the resolution and readability of monochromatic, high-contrast images, e.g., a black graphic image on white background, a gray-scale pixel rendering method may be used. A gray-scale pixel rendering method may include sampling each pixel of a pixel-matrix representation of the image to determine a percentage of the pixel-area covered by the graphic object for each partly-covered pixel and reproducing the pixel with a gray-level responsive, e.g., proportional, to the percentage of the pixel area covered by the graphic object. A drawback of this method may be a fuzziness of the object as shown in FIG. 12B.

An improvement of graphic object rendering may include sub-pixel rendering. Sub-pixel rendering for a LCD display may utilize a subpixel matrix instead of a full-pixel matrix. FIG. 12C illustrates an enlargement of the letter "A" as produced by RGB sub-pixel rendering techniques. As shown in FIG. 12C, each pixel is composed of 3 sub-pixels, whereby the rendering may be carried out separately for each sub-pixel. This method may allow improved readability compared to the full-pixel rendering methods. However, this method has a drawback of color fringes effects, which may result from luminance variation between neighboring sub-pixels, e.g., a sub-pixel covered by the graphic object may have a luminance level different from a neighboring sub-pixel not covered by the object. This problem may be particularly apparent at or near the edges of a displayed graphic object, e.g., along the contour of the graphic object.

According to an exemplary embodiment of the invention, a method for minimizing color fringes may be applied to a given sub-pixel configuration, for example, five-primary one dimensional arrangement 1101 (FIG. 11A), or to any other one-dimensional or two-dimensional configuration, as described in detail below.

Figure 12D:
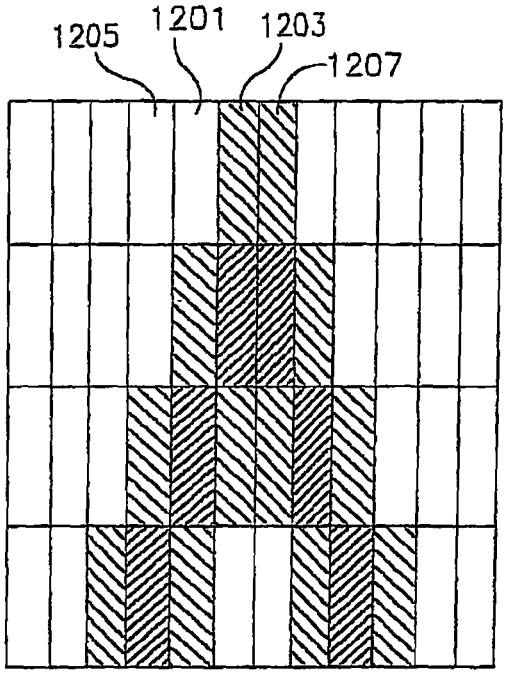
FIG. 12D is a schematic illustration of a character enlarged by an initial stage of n-primary sub-pixel rendering according to exemplary embodiments of the invention.
Figure 12E:
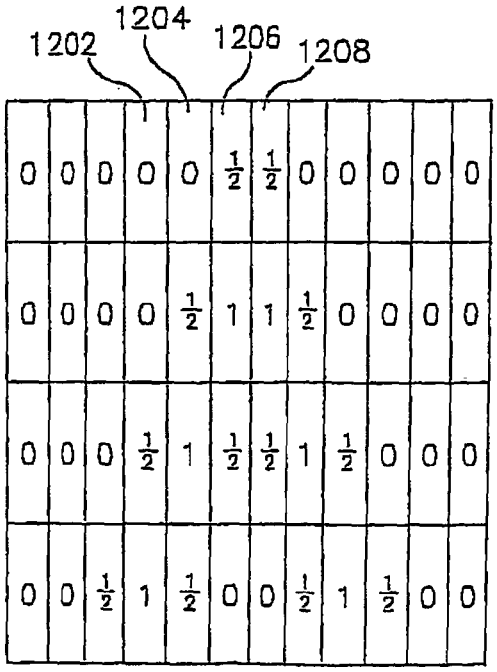
FIG. 12E is a schematic illustration of a table showing initial coverage values that may be assigned to sub-pixels of the image of FIG. 12D based on an assignment method according to exemplary embodiments of the invention.

Reference is made to FIG. 12D, which schematically illustrates an enlargement of an upper part of the letter "A" using n-primary sub-pixel rendering according to exemplary embodiments of the invention, and to FIG. 12E, which schematically illustrates a table showing initial coverage values that may be assigned to sub-pixels of the image of FIG. 12D using an assignment method according to exemplary embodiments of the invention.

According to exemplary embodiments of the sub-pixel rendering method of the invention, each sub-pixel may be assigned with an initial coverage value, which may be related, e.g., proportional, to the percentage of the sub-pixel area covered by the graphic object, as illustrated schematically in FIGS. 12D and 12E.

Figure 12F:
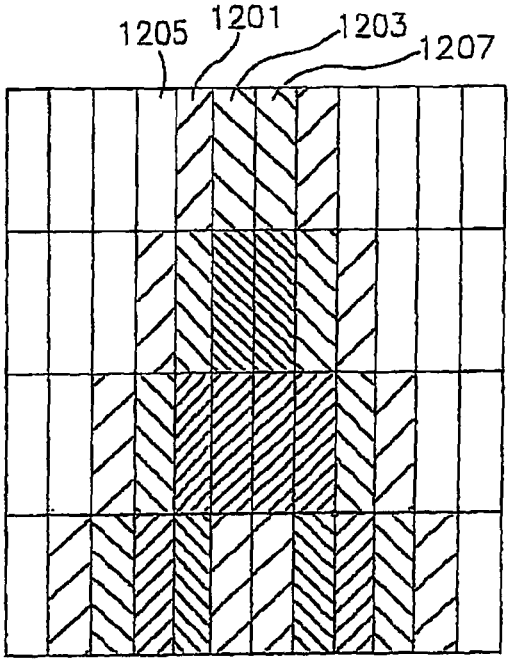
FIG. 12F is a schematic illustration of a character enlarged and adjusted by sub-pixel rendering according to exemplary embodiments of the invention.
Figure 12G:
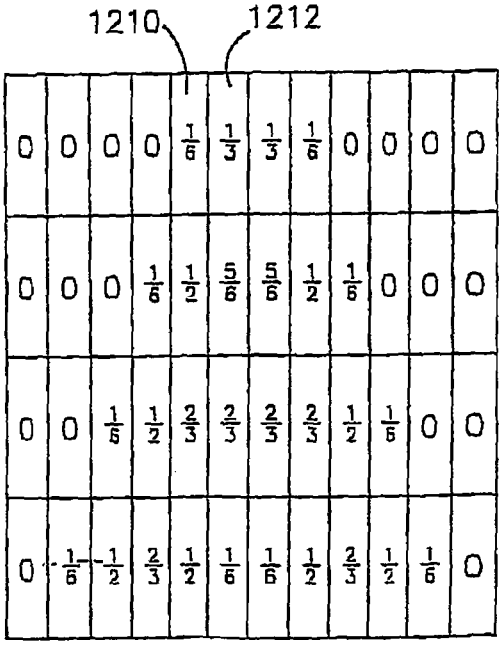
FIG. 12G is a schematic illustration of a table showing adjusted coverage values that may be assigned to sub-pixels of the image of FIG. 12F based on an assignment method according to exemplary embodiments of the invention.

Reference is also made to FIG. 12F, which schematically illustrates an enlargement of an upper part of the letter "A" using sub-pixel rendering according exemplary embodiments of the invention, and to FIG. 12G, which schematically illustrates a table showing adjusted coverage values that may be assigned to sub-pixels of the image of FIG. 12F based on an assignment method according to exemplary embodiments of the invention.

According to exemplary embodiments of the sub-pixel rendering method of the invention, an adjusted coverage value may be assigned to each of three subpixels, composing a pre-defined triad, based on a predetermined smoothing function, for example, a weighted average. The smoothing function may be used to reduce or eliminate variations in the initial coverage values of the different sub-pixels composing each sub-pixel triad. By adjusting the brightness of the sub-pixel in accordance with the adjusted coverage values, a substantially color-neutral luminance, e.g., a gray color, may be viewed throughout the image, and particularly along the contour of the graphic object, as described below.

According to an exemplary embodiment of the invention, the smoothing function may include a weighted average, wherein predetermined weights are assigned to the sub-pixels of the triad, for example, a weight of 1 may be assigned to each subpixel in the triad. According to one exemplary embodiment of the invention, an adjusted coverage value 1210 assigned to sub-pixel 1201 may be determined by averaging initial coverage value 1204 of subpixel 1201 and initial coverage values 1202 and 1206 of neighboring sub-pixels 1205 and 1203, respectively. According to this exemplary embodiment, sub-pixel 1201 may be assigned an adjusted coverage value of ⅙, which corresponds to a weighted average of a set of initial coverage values of the triad containing sub-pixel 1201, for example, initial coverage values (0, 0, 0.5). According to another exemplary embodiment of the invention, sub-pixel 1203 may be assigned an adjusted coverage value 1212 corresponding to a weighted average of initial coverage values 1204, 1206 and 1208 of sub-pixels 1201 and 1203 and 1207, respectively. According to this exemplary embodiment, sub-pixel 1203 may be assigned an effective coverage value of ⅓, which corresponds to a weighted avenge of a set of initial coverage values of the triad containing sub-pixel 1203, for example, coverage values (0, 0.5, 0.5).

According to further embodiments of the invention, the weighted average may include assigning a different weight to each sub-pixel.

According to exemplary embodiments of the invention, there may be n different triad arrangements for a one dimensional n-primary configuration. Thus, according to an exemplary embodiment of the invention, n different weighting functions may be defined to allow calculating an adjusted coverage value for each sub-pixel of the arrangement, e.g., arrangement 1101 (FIG. 11A).

According to another embodiment of the invention, a method forming color fringes may be applied to a six primary, two dimensional arrangement, e.g., arrangement 1102 (FIG. 11B), or to any other two-dimensional configuration. The method may include using a smoothing function for assigning an adjusted coverage value to each sub-pixel of the triads composing a row and to each sub-pixel of the pairs composing a column as described above. According to exemplary embodiments of the invention, there may be 2n different arrangements available in a two-dimensional n-primary display. Thus, according to an exemplary embodiment of the invention, 2n different smoothing functions may be pre-defined to allow calculating an adjusted coverage value for each sub-pixel of the two-dimensional arrangement.

Figure 13A:
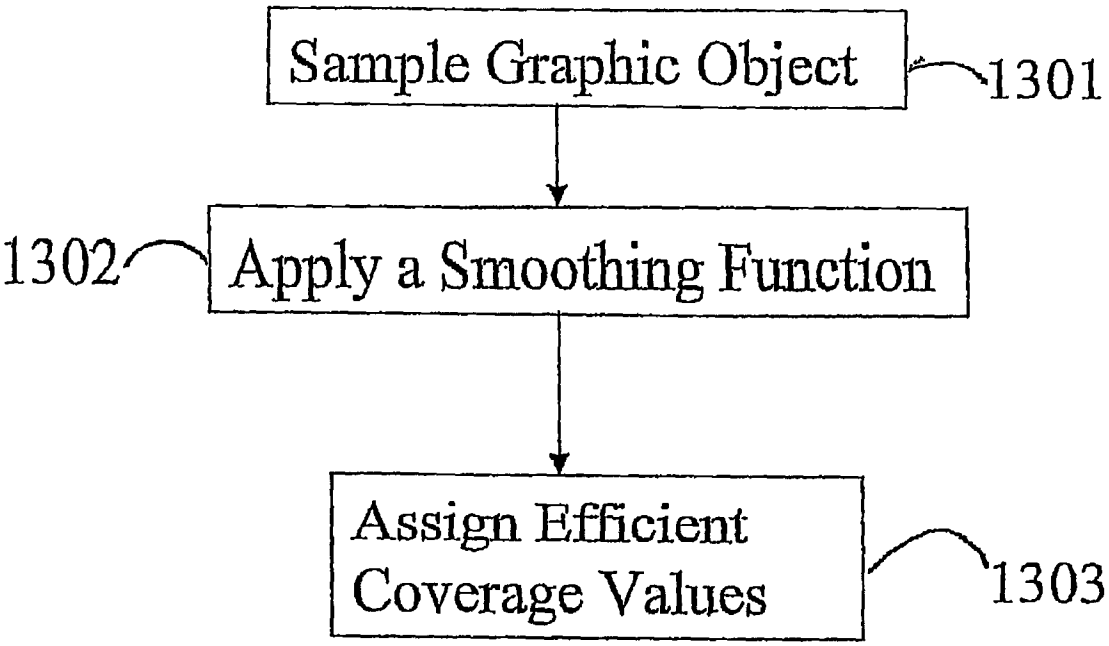
FIG. 13A is a schematic block illustration of a method for multi-primary sub-pixel rendering in accordance with exemplary embodiments of the invention.

FIG. 13A is a schematic block illustration of a method for multi-primary sub-pixel rendering in accordance with exemplary embodiments of the invention. The method of FIG. 13A may allow sub-pixel rendering with enhanced resolution and enhanced readability, while minimizing color fringe effects. This may be achieved by monitoring the contour and/or edges of a viewed graphic object.

As indicated at block 1301, the method may include, according to embodiments of the invention, sampling a two-dimensional graphic object at sub-pixel resolution and assigning an initial coverage value to each sub-pixel according to the corresponding relative coverage of the graphic object. For example, if the graphic object covers 50% of a certain sub-pixel, then the sub-pixel may be assigned an initial coverage value of 0.5.

As indicated at block 1302, the method according to embodiments of the invention may include calculating a smoothing function, for example, a running weighted average, i.e., a continual re-calculation, of the initial coverage values of sub-pixel triads.

As indicated at block 1303, an adjusted coverage value may be assigned to each sub-pixel according to the result of the smoothing function applied at block 1302.

Figure 13B:
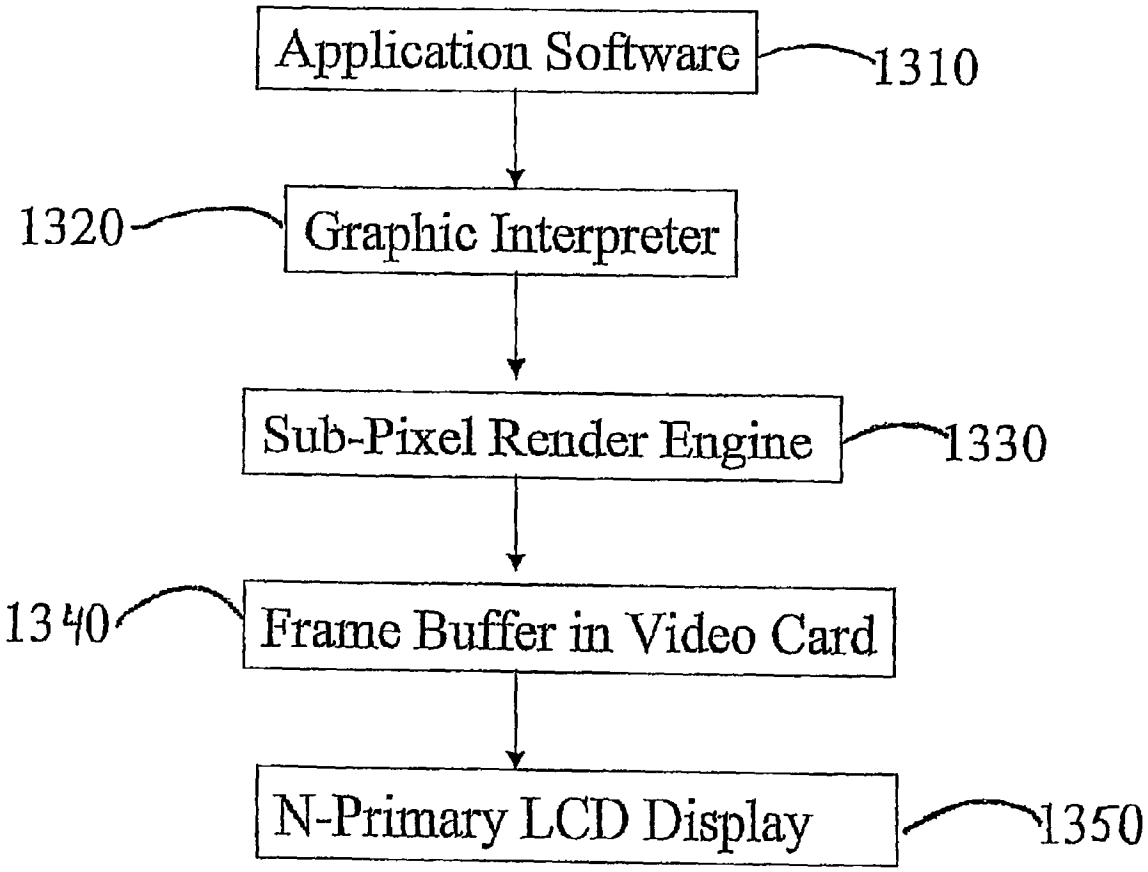
FIG. 13B is a schematic block illusion of data flow in a system of multi-primary sub-pixel rendering of a multi-primary display in accordance with exemplary embodiments of the invention.

FIG. 13B is a schematic block diagram illustrating the flow of data in a system for sub-pixel rendering in accordance with exemplary embodiments of the invention.

According to embodiments of the invention, the sub-pixel rendering system may include receiving an input corresponding to a graphic object from a suitable application software 1310, for example, a word-processing software. The system may further include a graphic interpreter 1320, a sub-pixel rendering unit 1330, a video card Same buffer 1340, and an n-primary display 1350, which may include any type of more-than-three pry color display, for example, an n-primary color LCD display according to embodiments of the invention.

Application software 1310 may be used to define graphic objects, e.g., text characters, and their size and position.

Graphic interpreter 1320 may be used to translate the text and/or other graphic objects defined by application software 1310 into continuous two-dimensional objects, the contours of which may be defined by simple curves.

The two-dimensional graphic objects may be processed by sub-pixel rendering unit 1330, which may sample the graphic objects at the sub-pixel resolution of the display, to obtain a relative coverage at each sub-pixel, and may apply a smoothing function, as discussed above, to provide a smooth bitmap defining the image to be displayed.

The bitmap provided by sub-pixel rendering unit 1330 may be temporarily stored in graphic card frame buffer 1340 and may be further transferred and displayed on n-primary display 1350.

In TV applications, text and graphic information may appear in the form of sub-titles, closed captioning, or TELETEXT signals. In digital TV application, this information may be included in a broadcast MPEG format, and may be decoded by a MPEG decoder, for example, by a set-off box or a DVD player. According to embodiments of the invention, a data flow system supporting sub-pixel rendering as described herein may be used to support fee applications of digital TV, for example, interactive text and graphics presentations.

According to another embodiment of the invention, the n-primary color arrangements described above may be used to display a wider range of gray levels compared to a RGB LCD display.

A pre-defined bit depth of size bd may yield a range of $2^{bd}$ gray levels for each one of the primary colors used in a display, e.g., an 8-bit depth may yield 256 gray-levels for each primary color. In conventional RGB LCD displays, a combination of all 3 primary colors is used in order to display most colors, or to adjust the gray-level of a given color. Therefore, the maximum number of gray-levels for each displayed color depends on the bit-depth, e.g., 256 gray levels, numbered 0 to 255, for an 8-bit depth, wherein levels 0 and 255 correspond to black and white, respectively. In such a display, the brightest displayable white may be obtained using level 255 for all three primaries. In a similar manner, the darkest displayable gray is obtained when all three primary-color sub-pixels are activated at level 1.

Since the pixels of an input image may include a wider range of gray-levels, i.e., a larger bitmap, for example, a 10-bit depth, many gray-levels may not be reproducible by existing displays. This problem may be particularly significant at low gray levels. Embodiments of the present invention may expand the reproducible bit-depth of a displayed image in a more-than-three primary display, for example, to a bit-depth of more than 8 bits, by reproducing additional gray-levels using combinations of only some of the sub-pixels in certain pixels or repeating units. This aspect of the invention may be advantageous in producing low gray-level pixels, because the variety of gray-levels may be particularly significant for the lower gray-levels.

According to exemplary embodiments of the invention, a more-than-three primary color sub-pixel arrangement, for example, 6-primary RGBMCY sub-pixel arrangement 1102 (FIG. 11A), wherein each sub-pixel has an 8-bit depth, may enable reproduction of an expanded gray-level range, e.g., arrange of more than 256 gray levels. For example, several different sub-pixel combinations of arrangement 1102 may be used to display a substantially white color using sets of sub-pixel pairs or triads as described in detail above. Thus, sub-pixel arrangements in accordance with the invention, for example, arrangement 1102, may enable displaying a substantially white color without using all primary color sub-pixels, e.g., using only part of the sub-pixels of a displayed pixel or repeating unit. For example, in a display using arrangement 1102, the brightest white may be provided by setting the value of each sub-pixel to 255. The darkest gray achievable by a full pixel, corresponding to 8-bit color depth, may be obtained by setting the luminance value of each sub-pixel to 1. However, darker grays may be achieved according to embodiments of the invention, for example, by setting the values of the RGB sub-pixels to 1 while concurrently setting the luminance values of the CMY sub-pixels to 0. Since, according to an exemplary embodiment of the invention, the RGB triad may have only about a third or less of the total brightness of RGBMCY arrangement 1102, the darkest gray created by the RGB triad of arrangement 1102 may be darker than the darkest level of gray obtained by exciting all sub-pixels. Thus, by use of different triad combinations, according to exemplary embodiments of the invention, the displayable gray level range may be widened, e.g., by a factor of about 4, yielding an increase in bit-depth from about 8 to about 10.

Although the above exemplary embodiments have been described for gray-level display, it will be appreciated by persons sided in the art that the n-primary arrangements described above may also be used to produce an expanded bit depth, i.e., a wider range of gray-levels, for colors of different tints and hues.

Figure 14:
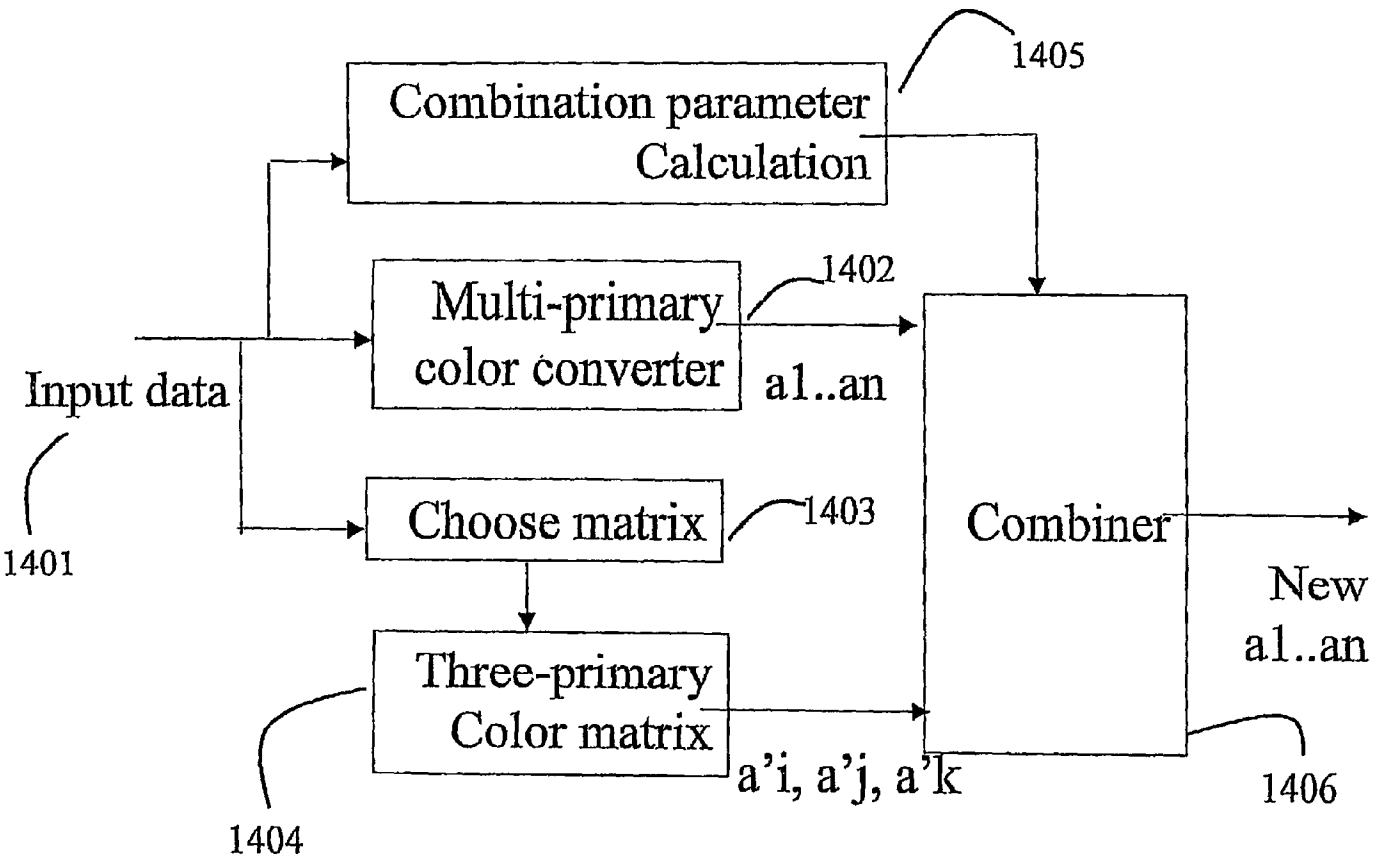
FIG. 14 is a schematic diagram of the flow of data in a LCD display system incorporating a method for increasing bit depth, in accordance with exemplary embodiments of the invention.

FIG. 14 is a schematic diagram of the flow of data in a LCD display system incorporating a method for expanding bit depth in accordance with exemplary embodiments of the invention.

Figure 15:
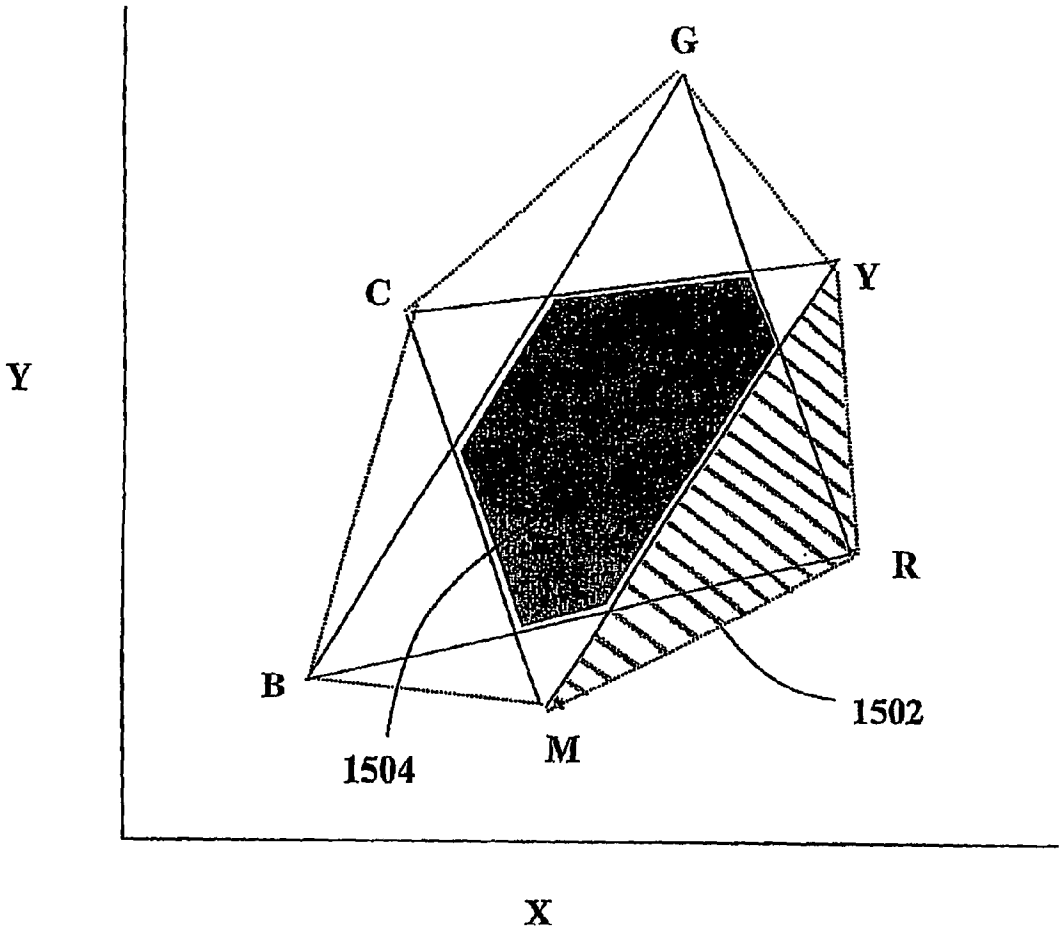
FIG. 15 is a schematic illustration of a chromaticity diagram representing a color gamut of a 6-primary display in accordance with an exemplary embodiment of the invention.

Reference is also made to FIG. 15, which schematically illustrates a chromaticity diagram representing the color gamut of a 6-primary display in accordance with an exemplary embodiment of the invention.

The method of FIG. 14 may include receiving input data, as indicated at block 1401.

A first channel may be used to process the input data and to create an n-primary output as indicated at block 1402.

For the 6 primary colors illustrated in FIG. 15, a selection of a triad of primary colors may define an effective field, e.g., effective field 1502 may be defined by a YMR triad. According to embodiments of the invention, in order to provide an expanded gray-level range for a desired color gamut, a triad of primary colors may be selected such that an effective field defined by the selected triad may include the desired color gamut, as explained in detail above.

Referring again to FIG. 14, the input data may further be used to select a set of three primary colors corresponding to the effective field required to produce a desired gray level range and color gamut, as indicated at block 1403. An effective field may be defined by different color triads, e.g., effective field 1504 may be defined by the RGB and YCM. Selection of the three primary colors from a set of available triads debug a required effective field may include optimization of display attributes, for example, luminance uniformity, smoothness, or any other objective, subjective or relative display attribute.

As indicated at block 1404, a second channel may be used to process the input data based on the three-primary colors selected at block 1403.

The Input data may be further used to calculate a combination parameter as indicated at block 1405. The combination parameter calculation may be based on providing a smooth display, a required level of brightness or any other related display attribute. For example, for a high luminance input, combining the channels may provide an output including substantially the multi-primary output of the first channel. For a low-luminance input, combining the channels may provide an output including substantially the 3-primary output of the second channel. For a substantially medium luminance input, the output may include a combination of both channels.

The first and second channels may be smoothly combined as indicated at block 1406, as a function of the combination parameter calculated at block 1405.

While certain features of the invention have been illustrated and described herein, many modifications, substitutions, changes, and equivalents will now occur to those of ordinary skill in the art. It is, therefore, to be understood that the appended claims are intended to cover all such modifications and changes as the within the true spirit of the invention.

The invention claimed is:

1. A color display device for displaying a color image having n different primary colors, wherein n is greater than or equal to four, the device comprising an array of substantially rectangular sub-pixels configured to have at least one repeating unit, said repeating unit including at least one sub-pixel representing each of said n different primary colors, wherein said sub-pixels are arranged in a single row to form said repeating unit having an aspect ratio of 1:1.

2. A device according to claim 1 comprising a controller able to receive an input corresponding to said color image and to selectively activate at least some of said sub-pixels to produce one or more attenuation patterns corresponding to a gray-level representation of said color image.

3. A device according to claim 2, wherein said controller is able to activate at least one of said sub-pixels in accordance with an adjusted coverage value.

4. A device according to claim 3, wherein said controller is able to determine said adjusted coverage value by applying a smoothing function to initial coverage values of a group of less than n different primary color sub-pixels containing the activated sub-pixel.

5. A device according to claim 4, wherein said group of sub-pixels comprises two sub-pixels neighboring said activated sub-pixel.

6. A device according to claim 5, wherein the two sub-pixels neighboring said activated sub-pixel are located on one row or column.

7. A device according to claim 3, wherein said controller is able to determine said adjusted coverage value by applying first and second smoothing functions to initial coverage values of first and second groups of sub-pixels, respectively, wherein each of said first and second groups of sub-pixels contains the activated sub-pixel and comprises less than n different primary color sub-pixels.

8. A device according to claim 7, wherein said first group comprises two sub-pixels in a single row or column including said activated sub-pixel.

9. A device according to claim 7, wherein said second group comprises at least one neighboring sub-pixel on the same column or row as said activated sub-pixel.

10. A device according to claim 1, wherein said sub-pixels are arranged according to a hue order of said n different primary colors.

11. A device according to claim 1, wherein said sub-pixels of each said repeating unit are arranged in sub-sets, each sub-set comprising neighboring sub-pixels, wherein each one of said sub-sets has a relatively neutral white-balance.

12. A device according to claim 11, wherein one or more of said sub-sets comprises three neighboring color sub-pixels.

13. A device according to claim 12, wherein said three neighboring color sub-pixels are located on one row or column.

14. A device according to claim 11, wherein one or more of said sub-sets comprises sub-pixels of five primary colors arranged in the order red, green, blue, yellow and cyan.

15. A device according to claim 11, wherein one or more of said sub-sets comprises two neighboring color sub-pixels.

16. A device according to claim 15, wherein said two neighboring color-sub-pixels are located on one row or column.

17. A device according to claim 1, wherein sub-pixels of said repeating unit are arranged in a one-dimensional array.

18. A device according to claim 1, wherein said n different primary colors comprise red, green, blue and yellow.

19. A device according to claim 1, wherein said n different primary colors comprise at least five different primary colors.

20. A device according to claim 19, wherein said at least five different primary colors comprise red, green, blue, yellow and cyan.

21. A device according to claim 1, wherein said n different primary colors comprise at least six different primary colors.

22. A device according to claim 21, wherein said at least six different primary colors comprise red, green, blue, yellow, cyan and magenta.

23. A device according to claim 22, wherein said repeating units are arranged in first and second rows, said first row comprising color sub-pixels being shifted with respect to color sub-pixels of said second row.

24. A device according to claim 1, wherein said repeating unit comprises an arrangement of said sub-pixels that optimizes at least one property of said displayed image.

25. A device according to claim 24, wherein the arrangement of said sub-pixels is selected based on minimizing a harmonic of a transformation function applied to luminance values of a group of possible sub-pixel arrangements.

26. A device according to claim 25, wherein said transformation function comprises a Fourier Transform and wherein said harmonic comprises a first harmonic of said Fourier Transform.

27. A device according to claim 1, wherein the repeating unit is configured to optimize a gray-level range of said repeating unit.

28. A device according to claim 1, wherein the repeating unit is configured to optimize color saturation.

29. A device according to claim 1, wherein the repeating unit is configured to optimize luminance uniformity.

30. A device according to claim 1, wherein the repeating unit is configured to optimize image resolution.

31. A device according to claim 1, wherein the repeating unit is configured to optimize a property related to a color fringes effect.

32. A device according to claim 1 comprising an n-primary color Liquid Crystal Display (LCD) device, wherein said array of sub-pixels comprises an array of sub-pixel filters, each sub-pixel filter transmitting light of one of said n different primary colors.

33. The color display device of claim 1, wherein said sub-pixels are rectangular, having two parallel long sides and two parallel short sides, wherein said sub-pixels of each repeating unit are adjacent along their respective long sides, and wherein corresponding sub-pixels of repeating units being adjacent along said short sides have the same color.

34. The color display device of claim 33, wherein each repeating unit has m sub-pixels, and wherein the aspect ratio of each said sub-pixel is m:1.

35. A color display device for displaying a color image having n different primary colors, wherein n is greater than three, the device comprising:

an array of substantially rectangular sub-pixels configured to have at least one repeating unit comprising m sub-pixels, including at least one sub-pixel representing each of said n different primary colors, wherein said sub-pixels are arranged in a single row to form said repeating unit having an aspect ratio of 1:1; and a controller able to receive an input corresponding to said color image and to selectively activate at least some of said sub-pixels to produce one or more attenuation patterns corresponding to a gray-level representation of said color image.

36. A device according to claim 35, wherein said sub-pixels are arranged according to a hue order of said n different primary colors.

37. A device according to claim 35, wherein said sub-pixels of each said repeating unit are arranged in sub-sets, each sub-set comprising at least two neighboring sub-pixels, wherein each one of said sub-sets has a relatively neutral white-balance.

38. A device according to claim 37, wherein said at least two neighboring sub-pixels are located on one row or column.

39. A device according to claim 35, wherein said controller is able to activate at least one of said sub-pixels in accordance with an adjusted coverage value.

40. A device according to claim 39, wherein said controller is able to determine said adjusted coverage value by applying a smoothing function to initial coverage values of a group of less than n different primary color sub-pixels containing the activated sub-pixel.

41. A device according to claim 40, wherein said group of sub-pixels comprises two sub-pixels neighboring said activated sub-pixel.

42. A device according to claim 39, wherein said controller is able to determine said adjusted coverage value by applying first and second smoothing functions to initial coverage values of first and second groups of sub-pixels, respectively, wherein each of said first and second groups of sub-pixels contains the activated sub-pixel and comprises less than n different primary color sub-pixels.

43. A device according to claim 42, wherein said first group comprises two sub-pixels in a single row or column including said activated sub-pixel.

44. A device according to claim 43, wherein said second group comprises at least one neighboring sub-pixel on the same column or row as said activated sub-pixel.

45. A device according to claim 35, wherein sub-pixels of said repeating unit are arranged in a one-dimensional array.

46. A device according to claim 35, wherein said n different primary colors comprise red, green, blue and yellow.

47. A device according to claim 35, wherein said repeating unit comprises an arrangement of said sub-pixels that optimizes at least one property of said displayed image.

48. A device according to claim 47, wherein the arrangement of said sub-pixels is selected based on minimizing a harmonic of a transformation function applied to luminance values of a group of possible sub-pixel arrangements.

49. A device according to claim 48, wherein said transformation function comprises a Fourier Transform and wherein said harmonic comprises a first harmonic of said Fourier Transform.

50. A device according to claim 35, wherein the repeating unit is configured to optimize a gray-level range of said repeating unit.

51. A device according to claim 35, wherein the repeating unit is configured to optimize color saturation.

52. A device according to claim 35, wherein the repeating unit is configured to optimize luminance uniformity.

53. A device according to claim 35, wherein the repeating unit is configured to optimize image resolution.

54. A device according to claim 35, wherein the repeating unit is configured to optimize a property related to a color fringes effect.

55. A device according to claim 35 comprising an n-primary color Liquid Crystal Display (LCD) device, wherein said array of sub-pixels comprises an array of sub-pixel filters, each sub-pixel filter transmitting light of one of said n different primary colors.

56. The color display device of claim 35, wherein said sub-pixels are rectangular, having two parallel long sides and two parallel short sides, wherein said sub-pixels of each repeating unit are adjacent along their respective long sides, and wherein corresponding sub-pixels of repeating units being adjacent along said short sides have the same color.

57. The color display device of claim 56, wherein each repeating unit has m sub-pixels, and wherein the aspect ratio of each said sub-pixel is m:1.

58. A method of displaying a color image on a color display comprising an array of sub-pixels configured in a plurality of repeating units of at least one type, each repeating unit including at least one sub-pixel of each of n different primary colors, wherein n is greater than three and wherein said sub-pixels are arranged in a single row to form said repeating unit having an aspect ratio of 1:1, the method comprising producing a color combination by at least one of said repeating units without activating a sub-set of sub-pixels capable of producing substantially white light in the repeating unit producing said color combination.

59. The method of claim 58, wherein said sub-pixels are rectangular, having two parallel long sides and two parallel short sides, wherein said sub-pixels of each repeating unit are adjacent along their respective long sides, and wherein corresponding sub-pixels of repeating units being adjacent along said short sides have the same color.

60. The method of claim 59, wherein each repeating unit has m sub-pixels, and wherein the aspect ratio of each said sub-pixel is m:1.

61. A method of displaying a color image on a color display comprising an array of sub-pixels arranged in repeating units, each said repeating unit including m sub-pixels, including at least one of each of n different primary colors, wherein n is greater than three and wherein said sub-pixels are arranged in a single row to form said repeating unit having an aspect ratio of 1:1, the method comprising:

activating at least one of said sub-pixels in accordance with an adjusted coverage value.

62. A method according to claim 61 comprising determining said adjusted coverage value by applying a smoothing function to initial coverage values of a group of less than n different primary color sub-pixels containing said activated sub-pixel.

63. A method according to claim 62 comprising determining said adjusted coverage value by applying first and second smoothing functions to initial coverage values of first and second groups of sub-pixels respectively, wherein each of said first and second groups contains the activated sub-pixel and comprises less than n different primary color sub-pixels.

64. A method according to claim 62 comprising determining one or more of said initial coverage values.

65. The method of claim 61, wherein said sub-pixels are rectangular, having two parallel long sides and two parallel short sides, wherein said sub-pixels of each repeating unit are adjacent along their respective long sides, and wherein corresponding sub-pixels of repeating units being adjacent along said short sides have the same color.

66. The method of claim 65, wherein each repeating unit has m sub-pixels, and wherein the aspect ratio of each said sub-pixel is m:1.

* * * * *